US011173686B2

(12) United States Patent
Chu et al.

(10) Patent No.: US 11,173,686 B2
(45) Date of Patent: Nov. 16, 2021

(54) APPARATUS AND METHOD FOR ACCURATE CARTON FORMATION

(71) Applicant: WEXXAR PACKAGING, INC., Richmond (CA)

(72) Inventors: William Chu, Vancouver (CA); David Porteous, Chilliwack (CA); Melvin Tsen, Coquitlam (CA); Oliver Pringle, Vancouver (CA)

(73) Assignee: WEXXAR PACKAGING, INC., Richmond (CA)

( * ) Notice: Subject to any disclaimer, the term of this patent is extended or adjusted under 35 U.S.C. 154(b) by 217 days.

(21) Appl. No.: 16/111,653

(22) Filed: Aug. 24, 2018

(65) Prior Publication Data

US 2019/0061299 A1 Feb. 28, 2019

Related U.S. Application Data

(60) Provisional application No. 62/550,085, filed on Aug. 25, 2017.

(51) Int. Cl.

| | |
|---|---|
| ***B31B 50/78*** | (2017.01) |
| ***B31B 50/00*** | (2017.01) |
| ***B31B 50/04*** | (2017.01) |
| ***B31B 50/06*** | (2017.01) |
| ***B31B 50/07*** | (2017.01) |
| ***B31B 110/35*** | (2017.01) |
| ***B31B 100/00*** | (2017.01) |
| ***B31B 120/30*** | (2017.01) |

(52) U.S. Cl.

CPC ..... *B31B 50/784* (2017.08); *B31B 50/006* (2017.08); *B31B 50/044* (2017.08); *B31B 50/06* (2017.08); *B31B 50/066* (2017.08); *B31B 50/07* (2017.08); *B31B 2100/0022* (2017.08); *B31B 2110/35* (2017.08); *B31B 2120/302* (2017.08)

(58) Field of Classification Search

CPC ..... B31B 50/76; B31B 50/78; B31B 50/784; B31B 50/788; B31B 2105/002; B31B 2120/30; B31B 50/07; B31B 50/066; B31B 50/06; B31B 50/006; B31B 50/044; B31B 2100/0022; B31B 2120/302; B31B 2110/35

USPC ... 493/309, 310, 315, 317, 162, 167, 52, 51, 493/71, 34

See application file for complete search history.

(56) References Cited

U.S. PATENT DOCUMENTS 1,001,268 A * 8/1911 Heybach ..... 493/309
1,195,937 A * 8/1916 Wills ..... B31B 50/00 493/164
1,219,427 A * 3/1917 Beckman ..... 493/309
(Continued)

*Primary Examiner* — Dariush Seif
(74) *Attorney, Agent, or Firm* — Thompson Hine L.L.P.

(57) ABSTRACT

A carton forming machine includes a carton blank push up device that receives a substantially horizontal folded carton blank and reorients the folded carton blank from the substantially horizontal orientation to an upright orientation below and in a first direction alignment with a carton opening mechanism. A carton blank positioning apparatus shifts the upright folded carton blank in a second direction, transverse to the first direction, below the carton opening mechanism to define a second direction position of the upright carton blank below the carton opening mechanism before the carton opening mechanism engages the upright carton blank for opening of the upright carton blank.

12 Claims, 25 Drawing Sheets

(56) References Cited

U.S. PATENT DOCUMENTS 1,311,321 A * 7/1919 Crockett ..... 493/309
1,450,681 A * 4/1923 Holly ..... B65D 5/4279 493/74
1,495,191 A * 5/1924 Macnaughtan ..... 493/309
1,622,709 A * 3/1927 Evans ..... B65B 43/265 53/505
1,738,034 A * 12/1929 Burger ..... B31B 50/00 493/138
2,241,817 A * 5/1941 Howard ..... B31B 50/00 493/310
2,280,773 A * 4/1942 Ferguson ..... B31B 50/00 493/27
2,357,535 A * 9/1944 Monroe ..... B31B 50/00 493/123
3,564,980 A 2/1971 Winters
3,747,482 A 7/1973 Berney
3,991,660 A 11/1976 Calvert
4,011,799 A 3/1977 Chidsey
4,170,929 A 10/1979 McDowell
4,213,285 A 7/1980 Mancini
4,498,893 A 2/1985 Odom
4,553,954 A * 11/1985 Sewell ..... B31B 50/006 493/309
4,857,038 A 8/1989 Tacchini
4,915,678 A 4/1990 Morita
5,156,582 A 10/1992 Thompson
5,312,316 A * 5/1994 Wu ..... B31B 50/00 493/123
5,440,852 A 8/1995 Lam
5,480,371 A 1/1996 Morita
5,531,661 A 7/1996 Moncrief
5,772,568 A 6/1998 Chen
6,080,095 A 6/2000 Chen
6,309,335 B1 * 10/2001 Holton ..... B31B 50/00 493/120
6,319,183 B1 11/2001 Ballos, III
6,915,622 B2 7/2005 Spatafora
6,929,593 B1 8/2005 Chen
6,971,980 B2 12/2005 Chiu Chen
7,131,941 B2 11/2006 Makar
7,192,393 B2 3/2007 Makar
7,311,650 B2 12/2007 Makar
7,422,552 B2 9/2008 Zepf
7,510,517 B2 3/2009 Goodman
7,828,708 B2 11/2010 Huang
9,266,297 B1 * 2/2016 Flaming ..... B31B 50/00
9,409,367 B2 * 8/2016 Graham ..... B31B 50/00
2004/0162207 A1 8/2004 Ruf
2006/0096712 A1 5/2006 Makar
2007/0072757 A1 3/2007 Goodman
2007/0082799 A1 4/2007 Makar
2007/0128898 A1 6/2007 Makar
2008/0113856 A1 * 5/2008 Chen ..... 493/313
2009/0093354 A1 * 4/2009 Johnson ..... B65B 43/265 493/52
2009/0098991 A1 * 4/2009 Graham ..... B31B 50/00 493/162
2009/0170678 A1 * 7/2009 Smith ..... B31B 50/00 493/51
2009/0239726 A1 9/2009 Huang
2010/0263333 A1 * 10/2010 Langen ..... B65D 5/42 53/456
2012/0100976 A1 4/2012 Graham
2014/0073497 A1 3/2014 Mack
2015/0031517 A1 1/2015 Cavazza
2015/0360433 A1 * 12/2015 Feijen ..... B31B 50/74 53/456
2016/0159026 A1 * 6/2016 Porteous ..... B65G 59/068 493/126
2018/0043650 A1 * 2/2018 Heath ..... B31B 50/784
2018/0319525 A1 * 11/2018 Langen ..... B65H 3/42
2019/0061299 A1 * 2/2019 Chu ..... B31B 50/006

* cited by examiner

Fig. 8A
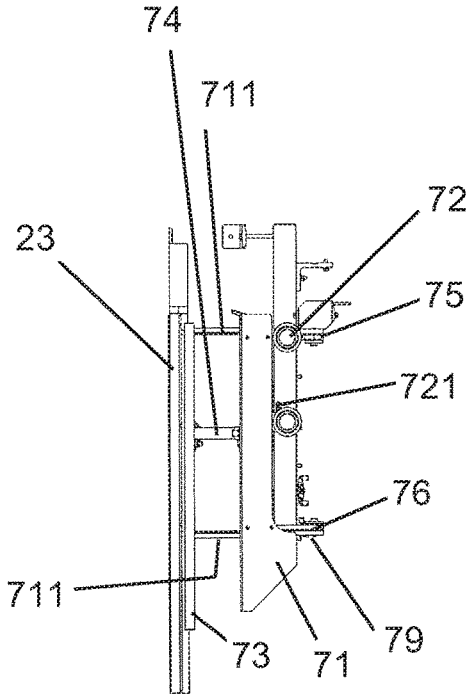
Fig. 8B
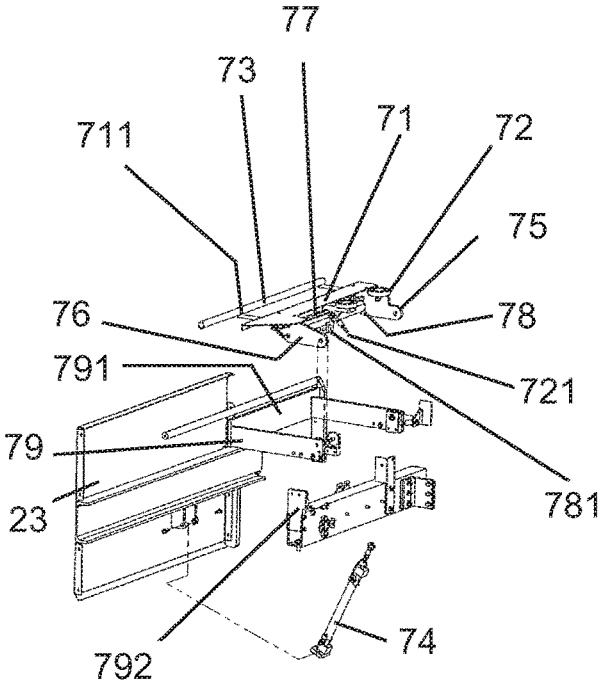
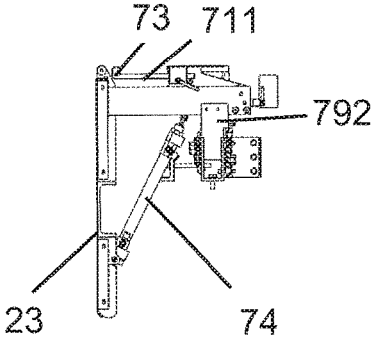
Fig. 8C
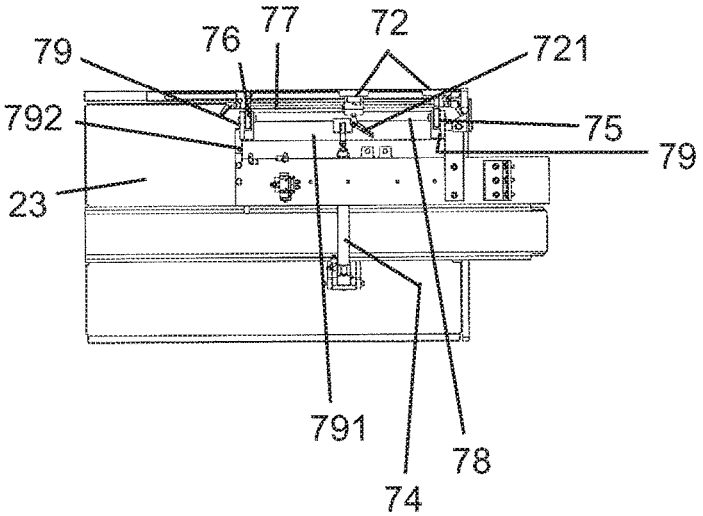
Fig. 8D

Fig. 10A
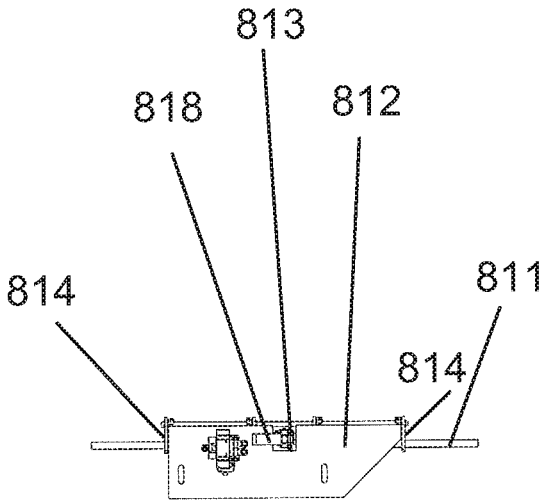
Fig. 10B
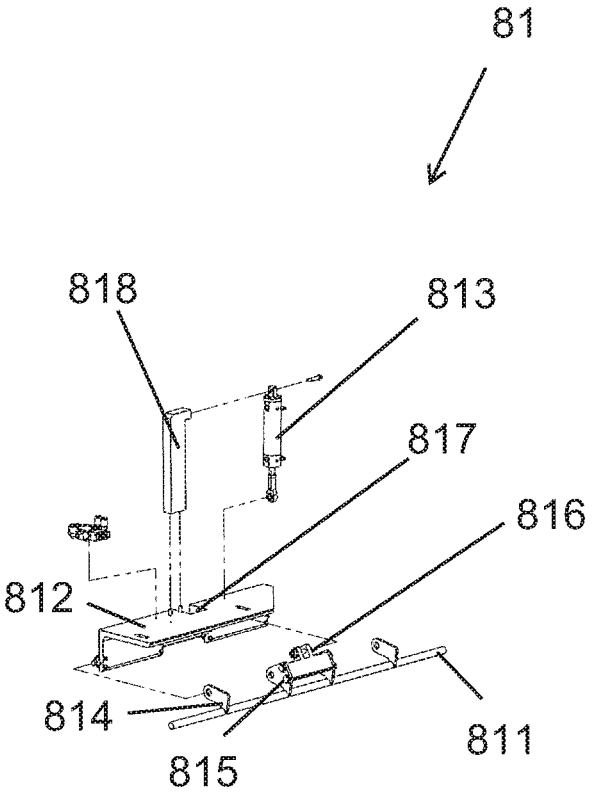
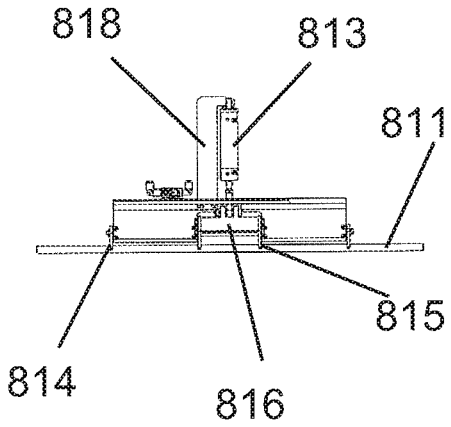
Fig. 10C
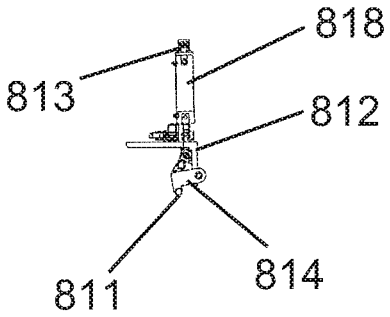
Fig. 10D

APPARATUS AND METHOD FOR ACCURATE CARTON FORMATION

TECHNICAL FIELD

This application relates generally to carton erectors and more particularly to an apparatus for erecting folded carton blanks including an arrangement for accurate positioning of folded carton blanks relative to a carton opening device.

BACKGROUND

In the packaging industry, carton forming machines, groups of vertically oriented folded carton blanks, and have carton blank feeders which, in general, are two types.

First, the carton blanks feeder consists of two long parallel carton blank holding arms mounted on the entrance of the carton forming machine. The two carton blank holding arms are mounted at the front of the carton forming machine at 45°, and two pusher arms are connected with the two parallel carton blank holding arms. At the lower end of each of the pusher arms, a heavy metal weight is hanging there to assist the cartons sliding on the carton holding arms. In use, a vertical pile of folded carton blanks are placed in the space inside the parallel carton blanks holding arms, the two sides of the carton blanks are held by the holding arms and at the back of the carton blanks, the pusher arm is attached at the last carton blank of the whole pile of the carton blanks and based on the gravity force and the downward slope formed by the holding arms, forming a slant to slide the carton blanks towards the folded carton blank opening device or suction cups.

Another type of carton blanks feeder is a set of two long carton blanks supporting arms. They are parallel to each other and mounted at the front end of the carton forming machine. At the bottom of the two long carton blanks supporting arms, two conveyor belts are mounted between these two long carton blanks supporting arms. A pusher arm is also mounted at one of the carton blanks supporting arms. In operation, the carton blanks are placed in the space between the two long carton blanks supporting arms and the carton blanks are driven to the carton forming machine by the conveyor belts. The pusher arm with sensors will push the carton blanks towards the machine to open by a folded carton blank opening device or by suction cups.

Problems of these two types of the carton blank feeding and transporting systems are: first, depending on the gravity force and the downward slope formed by the carton blank holding arms, forming a slant to slide the carton blanks can cause blanks to jam especially when the carton blanks have more friction and are not slippery enough to smoothly slide to the machine. For the second type of feeder, when the carton blanks are moving along the two long supporting arms towards the pin blocks or suction cups by a pusher, jams may occur because the blanks are loosely moving within the arms. Secondly, after a pile of vertically folded blanks are loaded, a manual adjustment/check must be done to ensure blanks are in the right position for blank opening. If the carton blanks are not in a right position, the machine may jam. This kind of adjustment is time consuming and tends to decrease the productivity of the machine and machine operator. Thirdly, the disadvantage of vertical carton blank feeders is that the carton blanks stand in the feeder on the carton flaps, and thus, the quality of the carton and the weight of the blanks may cause the carton blank to resist movement in the feeder and potentially jam. Further, if the user wants to load more carton blanks into the feeder at one time, the carton blank feeder needs to be longer and longer, requiring a larger machine footprint.

One attempt can be found in U.S. Patent Publication No. 2016/0159026, in which a pile of horizontal folded carton blanks is placed in a storage rack which is located in front of a carton forming machine and at the bottom of the storage rack, a conveyor belt with a lug or lugs mounted on it is operated to push a folded carton blank out from the bottom of the stack. The lug or lugs on the conveyor belt will send the folded blank to the carton blank stand up device so that a folded carton blank opening device can stretch or pivot open the folded blank. In this attempt, the problems of jam or moving of the carton blanks in the traditional vertical folded carton blanks storage rack were addressed. But the machined design does not reset the position of the carton blanks accurately under the folded carton blank opening device for the opening step, and therefore the machine operator must position the carton blanks accurately when loading.

SUMMARY

In one aspect, a carton forming machine includes a carton blank storage rack holding a carton blank stack formed by a plurality of substantially horizontal folded carton blanks. A carton blank transport device is arranged to pick a folded carton blank from the stack and transport the folded carton blank in a conveyance direction along a conveyance path toward a carton opening mechanism. A carton blank push up device receives the folded carton blank from the carton blank transport device and reorients the folded carton blank from the substantially horizontal orientation to an upright orientation below the carton opening mechanism. A carton blank positioning apparatus receives and supports the upright folded carton blank and shifts the upright folded carton blank in a set direction transverse to the conveyance direction in order to establish an accurate lateral position of the upright folded carton blank below the carton opening mechanism before the carton opening mechanism engages the upright carton blank for opening of the upright carton blank.

In another aspect, a carton forming machine includes a carton blank push up device that receives a substantially horizontal folded carton blank and reorients the folded carton blank from the substantially horizontal orientation to an upright orientation below and in a first direction alignment with a carton opening mechanism. A carton blank positioning apparatus shifts the upright folded carton blank in a second direction, transverse to the first direction, below the carton opening mechanism to define a second direction position of the upright carton blank below the carton opening mechanism before the carton opening mechanism engages the upright carton blank for opening of the upright carton blank.

In a further aspect, a method of handling carton blanks in a carton forming machine involves: (a) storing a plurality of substantially horizontally oriented folded carton blanks in a stack at a carton blank station; (b) automatically picking a folded carton blank from the top of the stack and conveying it in a substantially horizontal orientation along a conveyance path in a first direction toward a carton opening mechanism; (c) automatically shifting the folded carton blank of step (b) upward into an upright orientation with a first set position that is below and in a first direction alignment with the carton opening mechanism; and (d) automatically shifting the folded carton blank of step (c) in a second direction, transverse to the first direction, and into a second set position that is below and in a second direction alignment with the carton opening mechanism.

In one detailed example, a carton blank feeding system is mounted on the carton forming machine, which is located at the front of the machine. The carton blank feeding system includes a folded carton blank storage rack, and a folded carton blank transport device which includes a conveyor belt, a motor and three vertical threaded shafts attached to another motor. The folded carton blank storage rack allows a horizontal pile of folded carton blanks to load into it from the side (e.g., from a feed conveyor). The method of loading the folded carton blank storage rack is to put the carton blanks horizontally at a feed side of the folded carton blank storage rack and the conveyor belt will proceed in a forward direction to take the horizontal pile of folded carton blanks into the folded carton blank storage rack. The amount of blanks loaded in the folded carton blank storage rack will only make the pile of carton blanks higher and would not need more horizontal space to extend the folded carton blanks storage rack for placing more blanks. The conveyor belt not only can move forward, it can also move backward. The purpose of the forward movement is to take in the heavy pile of folded carton blanks into the carton blanks storage rack. On the other hand, the backward movement of the conveyor belt can help to move the unused folded carton blanks out of the carton blank storage rack in order to change to another type of folded carton blank. This arrangement saves the operator time putting in and taking out the folded carton blanks; especially, when the pile of folded carton blanks is heavy. A blocking plate is located at the front lower end of the carton blank storage rack, it is used to prevent the folded carton blanks from falling out of the carton blank storage rack when loading or unloading the folded carton blanks. The folded carton blank storage rack frame has four long flat metal bars that stand as four legs and on the top of each of these four legs there is a respective flat bar, resulting in four flat bars, each mounted to one of the legs to form the folded carton blanks storage rack frame. The folded carton blank transport device is mounted on a folded carton blank vertical transport device, and the folded carton blank vertical transport device on the folded carton blanks storage rack. On the top of the folded carton blank storage rack, a motor which belongs to the folded carton blank vertical transport device is mounted to drive the movement of one driven belt. The driven belt is connected with five pulleys to the three vertical threaded shafts. The three vertical threaded shafts are located at two sides of the folded carton blanks storage rack. These three vertical threaded shafts are mounted on the sides of the conveyor belt by two metal plates and a vertical bar. When the motor is operating, it can drive the driven belt to move the three vertical threaded shafts so as to let the conveyor belt move upward for folded carton blank pick up or downward for the re-load of folded carton blanks into the folded carton blank storage rack. In the middle of the folded carton blanks storage rack, a big "【" shape metal bar is mounted to connect the folded carton blanks storage rack with the carton forming machine. Above the a big "【" shape metal bar, another long small metal bar is mounted. This long small metal bar is used for mounting of the folded carton blank pick up device. The folded carton blank pick up device includes two suction cups, two pneumatic cylinders, and a movement bar which allows the suction cups to move forward to pick the top horizontal folded carton blank from the storage rack and with the second cylinder raise the vacuum cups out of the way of the folded carton blank stand up device, or to move backward to put the folded carton blanks on the folded carton blank stand up device. The folded carton blank stand up device includes a flat plate, two grippers, a long rod and a pneumatic cylinder. The long rod and flat plate are designed to handle different sizes of carton blanks, and therefore they are very long and in most of the cases, no need to adjust the long rod for bigger or smaller cartons. After the folded carton blank stand up device receives a folded carton blank, it will push the blank upward to stand up with the bottom flap falling into the bottom flap position device of the accurate carton apparatus. At this time, the accurate carton apparatus will grasp the folded carton blanks and position the blanks accurately under the folded carton blank opening device for opening by moving the bottom flap position device. The accurate carton apparatus includes the bottom flap position device and an upward driving pneumatic cylinder with a vertical slide. The bottom flap position device includes a pneumatic cylinder which causes movement in a horizontal direction for lateral positioning below the carton blank opening device. The top flap push device is a long rod which is used to press the carton blanks against the folded carton blank opening device, a "¬" shaped plate and a pneumatic cylinder.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 8A-8D is different view of the folded carton blank stand up device;

FIG. 10A-10D is different view of the top flap push device;

DETAILED DESCRIPTION

Figure 19:
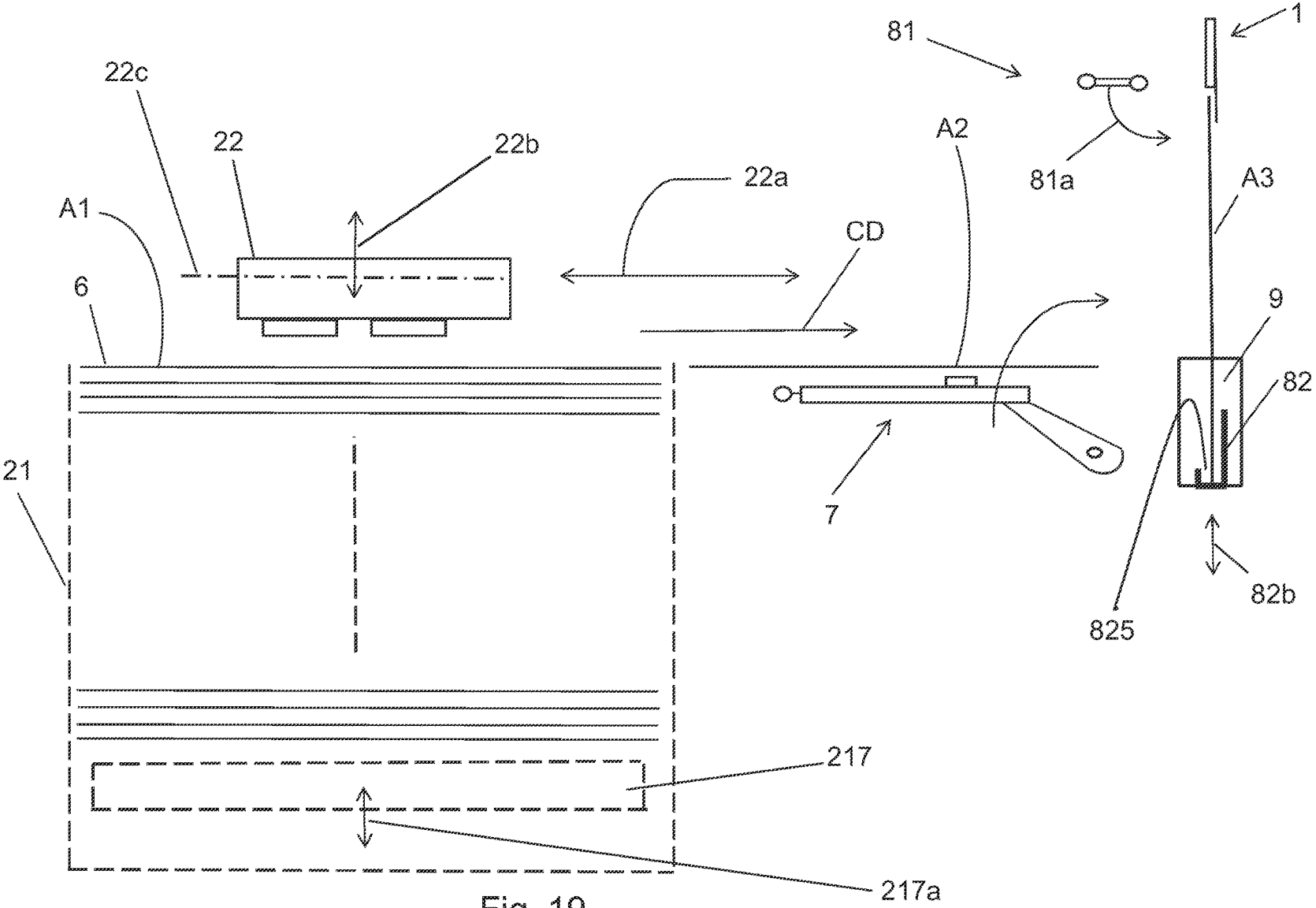
FIG. 19 is a schematic side elevation of the case forming apparatus.
Figure 20:
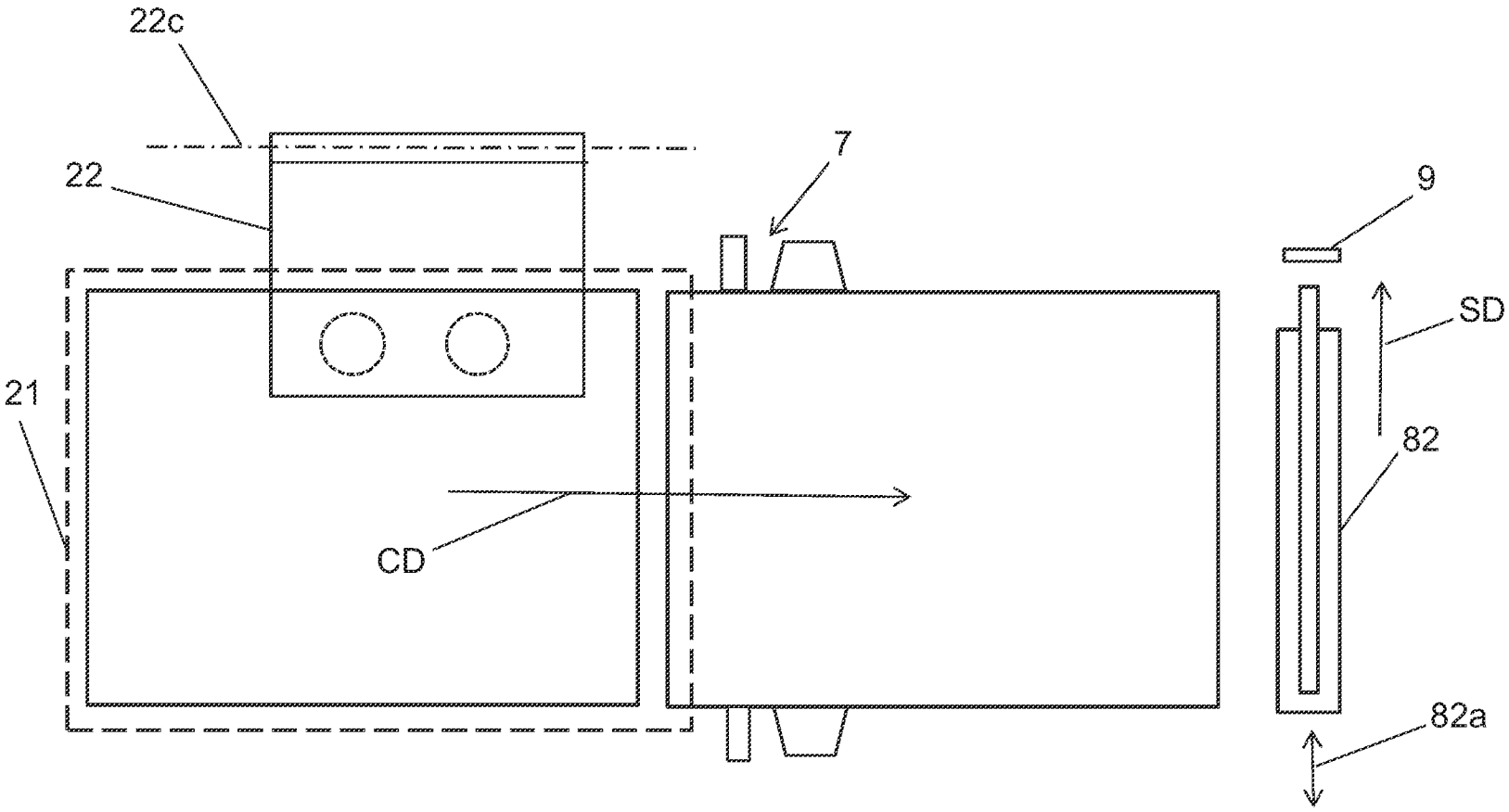
FIG. 20 is a schematic top plan view of FIG. 19 with carton opening device not shown.

Referring to FIGS. 19 and 20, the basic operation of a carton feed assembly of a carton forming machine is shown schematically. A carton blank storage rack 21 holds a carton blank stack formed by a plurality of substantially horizontal folded carton blanks 6. The storage rack includes a conveyor belt mechanism 217 that can also be raised to feed the carton blank stack upward, and lowered to load more carton blanks, per arrow 217*a*. A carton blank transport device 22 is movable per arrows 22*a* and is arranged to pick a folded carton blank from the top of the stack (position A1) and transport the folded carton blank in a conveyance direction CD along a conveyance path toward a carton opening mechanism 1 (into position A2). A carton blank push up or stand up device 7 receives the folded carton blank from the carton blank transport device (at position A2) and reorients the folded carton blank from the substantially horizontal orientation to an upright orientation below the carton opening mechanism 1 (position A3). A carton blank positioning apparatus 82 (also referred to as an accurate carton apparatus) receives and supports the upright folded carton blank and is movable per arrows 82*a* to shift the upright folded carton blank in a set direction SD transverse (here substantially perpendicular) to the conveyance direction CD in order to establish an accurate lateral position of the upright folded carton blank below the carton opening mechanism 1 before the carton opening mechanism engages the upright carton blank for opening of the upright carton blank. Thus, a correct position of the carton blank in both direction CD and direction SD, relative to the overhead carton opening mechanism 1, is achieved. The carton opening mechanism 1 may be of a type utilizing jaw plates with pins that engage the carton as describe in any of U.S. Pat. No. 4,553,954 or later variations such as those shown in U.S. Pat. Nos. 7,131,941, 7,192,393 or 7,422,552. The carton opening mechanism shifts the carton blank slightly in further direction SD as the carton blank is opened, and can then be moved downward into contact with the flap closing arms to close the bottom of the carton. The opened carton blank can then be conveyed further in set direction SD to a bottom tape sealing device (not shown) that tapes the bottom of the opened carton blank.

The carton blank transport device 22 is arranged above the carton blank storage rack and picks the folded carton blank from a top of the stack. The transport device 22 may include a pair of suction cups to pick up the carton blank and is movable along a support rail per arrows 22*a*, as will be described in greater detail below. The transport device 22 also moves up and down per arrows 22*b* (which may be achieved by a pivoting motion of the device about a horizontal axis 22*c* as will be described in further detail below).

The carton blank positioning apparatus includes an elongated bar/rail/member with an upward facing receiving slot or groove 825 in which bottom edges of flaps on the carton blank are positioned when the carton blank is moved into the upright orientation. The elongated bar/rail/member 82 is movable in the set direction SD. The carton blank positioning apparatus 82 includes a stop surface 9 toward one end of the elongated bar/rail/member. The elongated bar/rail/member moves in the set direction SD such that one side of the upright carton blank contacts the stop surface 9 to define the accurate lateral position of the upright folded carton blank. After the one side of the carton blank contacts the stop surface 9, continued movement of the elongated bar/rail/member in the set direction causes the elongated bar to slide relative to the upright carton blank sitting in the receiving slot/groove. A position of the stop surface 9 along the set direction SD may be adjustable to permit adjustment to accommodate different carton blank sizes. The elongated bar/rail/member is in a first position when the upright carton blank is initially loaded into the receiving slot, and one side of the upright carton blank protrudes beyond one end of the elongated bar when initially loaded, as per FIG. 20. The elongated bar/rail/member 82 can also be moved up and down per arrows 82*b* in order to engage the upright carton blank onto the carton opening device 1.

The carton blank positioning device includes a top flap pusher 81 movable between an upright position (shown in FIG. 19) and a lowered push position (achieved per arrow 81*a*). In the upright position, the top flap pusher 81 is above a travel path of a carton blank as the carton blank moves from the substantially horizontal orientation to the upright orientation, and in the lowered push position, the top flap pusher engages a trailing side of the carton blank top flaps. As shown, the top flap pusher may be mounted for pivotal movement between the upright position and the lowered push position. The top flap pusher 81 pushes a leading side of some of the top flaps against a panel member of the carton opening mechanism 1.

Thus, a method of handling carton blanks in a carton forming machine, the method comprising: (a) storing a plurality of substantially horizontally oriented folded carton blanks in a stack at a carton blank station; (b) automatically picking a folded carton blank from the top of the stack and conveying it in a substantially horizontal orientation along a conveyance path in a first direction toward a carton opening mechanism; (c) automatically shifting the folded carton blank of step (b) upward into an upright orientation with a first set position that is below and in a first direction alignment with the carton opening mechanism; and (d) automatically shifting the folded carton blank of step (c) in a second direction, transverse to the first direction, and into a second set position that is below and in a second direction alignment with the carton opening mechanism. For continuous operation, repeating steps (b), (c) and (d) for multiple folded carton blanks in the stack takes place. In step (c), the shifting operation loads the folded carton blank into a receiving slot in a bar/rail/member, and in a step (e) after step (d), the bar/rail/member upward to push the folded carton blank into engagement with a carton opening mechanism that operates to open the folded carton blank.

Referring now collectively to FIGS. 1-20, various detailed structures of the machine are shown. At the front part of the carton forming machine 1 is the folded carton blanks feeding system 2 which include a folded carton blanks storage rack 21, a folded carton blanks transport device 22 and a blocking plate 23. The said folded carton blanks storage rack 21 has four long flat metal bars 211, the four long flat metal bars 211 form the legs of the folded carton blanks storage rack 21. Another four flat bars 212 are mounted on the top of the four long flat metal bars 211 so as to form the frame of the folded carton blanks storage rack 21. In the folded carton blanks storage rack 21, the folded carton blanks transport device 22 is mounted. On the flat bars 212, a motor 213 which belongs to folded carton blanks transport device 22 is mounted. The motor 213 is connected with five pulleys 214 by one driven belt 215. Three of the said pulleys 214 are connected to three vertical threaded shafts 216. The said three vertical threaded shafts 216 are mounted on the opposite sides of the folded carton blanks storage rack 21 and pass through two metal plates 219 and a vertical bar 210 so as to link with the conveyor belt 217. The conveyor belt 217 is driven to move inward and outward by another motor 218. At the front end of the conveyor belt 217, a blocking plate 23 is installed to avoid the falling of the folded carton blanks into the machine. At one side of the folded carton blanks storage rack 21, a big "【" shape metal bar 3 is mounted to connect the folded carton blanks storage rack 21 with the carton forming machine 1. Above the big "【" shape metal bar 3, another long small metal bar 4 is mounted. This long small metal bar 4 is used for the folded carton blank pick up device 5 to mount on it.

When working, a pile of horizontal folded carton blanks 6 is placed at the entrance of the carton blank storage rack 21, then the motor 218 will drive the conveyor belt 217 to move inward to take the pile of horizontal folded carton blanks 6 from the entrance of the folded carton blanks storage rack 21 into the storage rack 21. The blocking plate 23 will prevent the pile of horizontal folded carton blanks 6 from falling into the machine. Then, the motor 213 of the folded carton blanks transport device 22 will drive the five pulleys 214 and the one driven belt 215 to move and as the pulleys 214 are connected with the three vertical threaded shafts 216, then the three vertical threaded shafts 216 will drive the conveyor belts 217 to move upward for folded carton blank pick up or move downward for re-load of folded carton blanks. At the same time, the folded carton blank pick up device 5 is starting to pick up the top horizontal folded carton blanks 61. The folded carton blank pick up device has two suctions cups 51 which are mounted on a "¬" shaped short plate 52, this "¬" shaped short plate 52 is mounted on a flat plate 53 and the flat plate 53 is mounted on two vertical small bars 56. The two vertical small bars 56 connected with a moving bar 54 and a pneumatic cylinder 55 is linked with the flat plate 53 and is used to push the suction cups 51 to swing down to pick up the top horizontal folded carton blanks 61 to the folded carton blank stand up device 7. The folded carton blank stand up device 7 is composed of a long flat plate 71, two grippers 72, a long rod 73 and a pneumatic cylinder 74.

The accurate carton apparatus 8 is mounted behind the folded carton blank stand up device 7. The said accurate carton apparatus 8 has a bottom flap position device 82 and upward driving pneumatic cylinder with vertical slide 829. The top flap push device 81 includes a long rod 811, a "¬" shaped plate 812 and a pneumatic cylinder 813. The bottom flap position device 82 has a "∟" shape bar 821, a small long bar 822, a moving rail 823, and a pneumatic cylinder 824.

The folded carton blanks storage rack 21 is mounted at the front of the carton forming machine 1. The folded carton blanks transport device 22 is mounted in the folded carton blanks storage rack 21 and at the end of the folded carton blanks transport device 22 is the folded carton blank pick up device 5. At the side of the folded carton blank pick up device 5 is the folded carton blank stand up device 7. The accurate carton apparatus 8 is located behind the folded carton blank stand up device 7.

Figure 1:
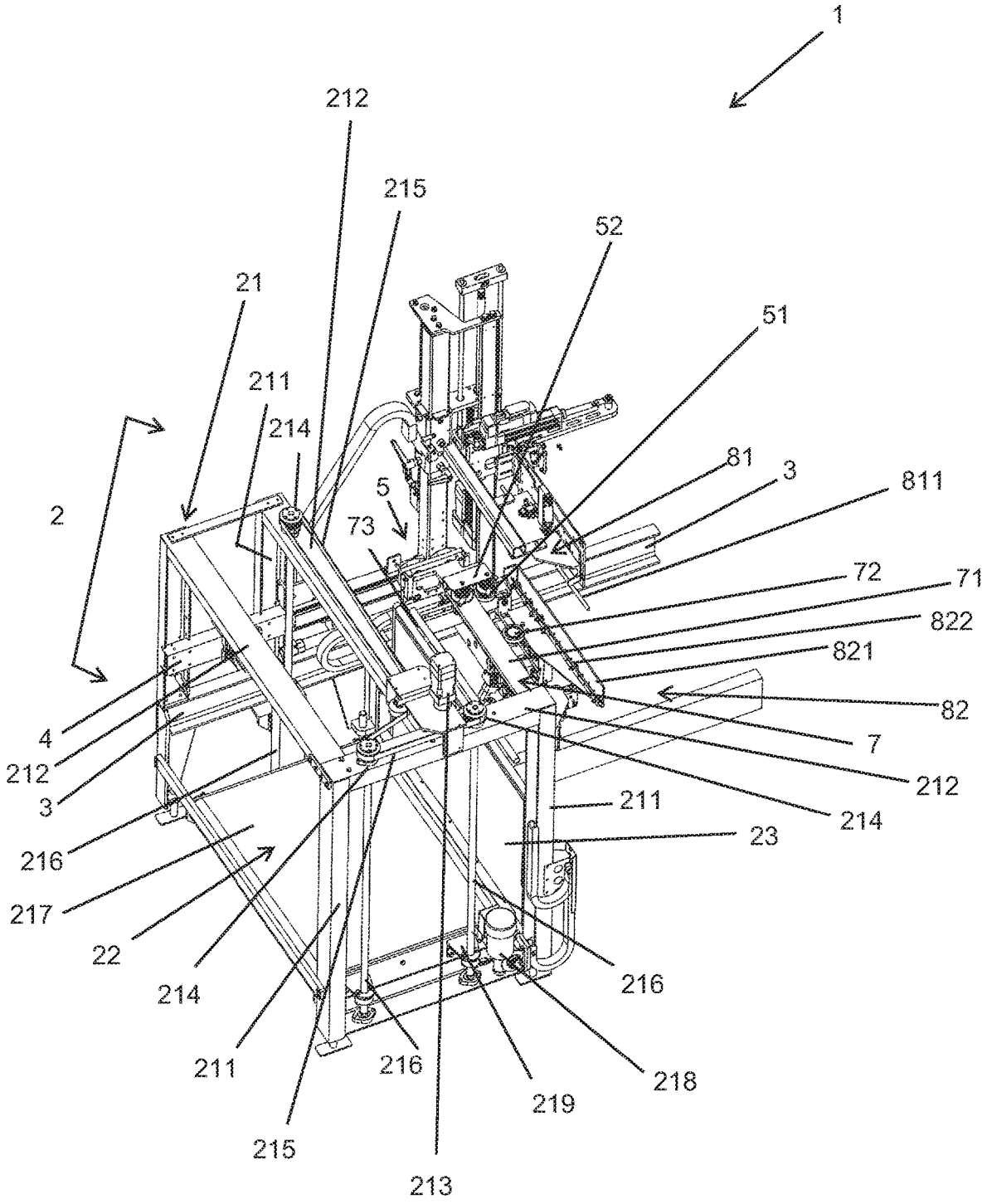
FIG. 1 is a perspective view of the carton forming machine with folded carton blanks storage rack and folded carton blank opening device.
Figure 2:
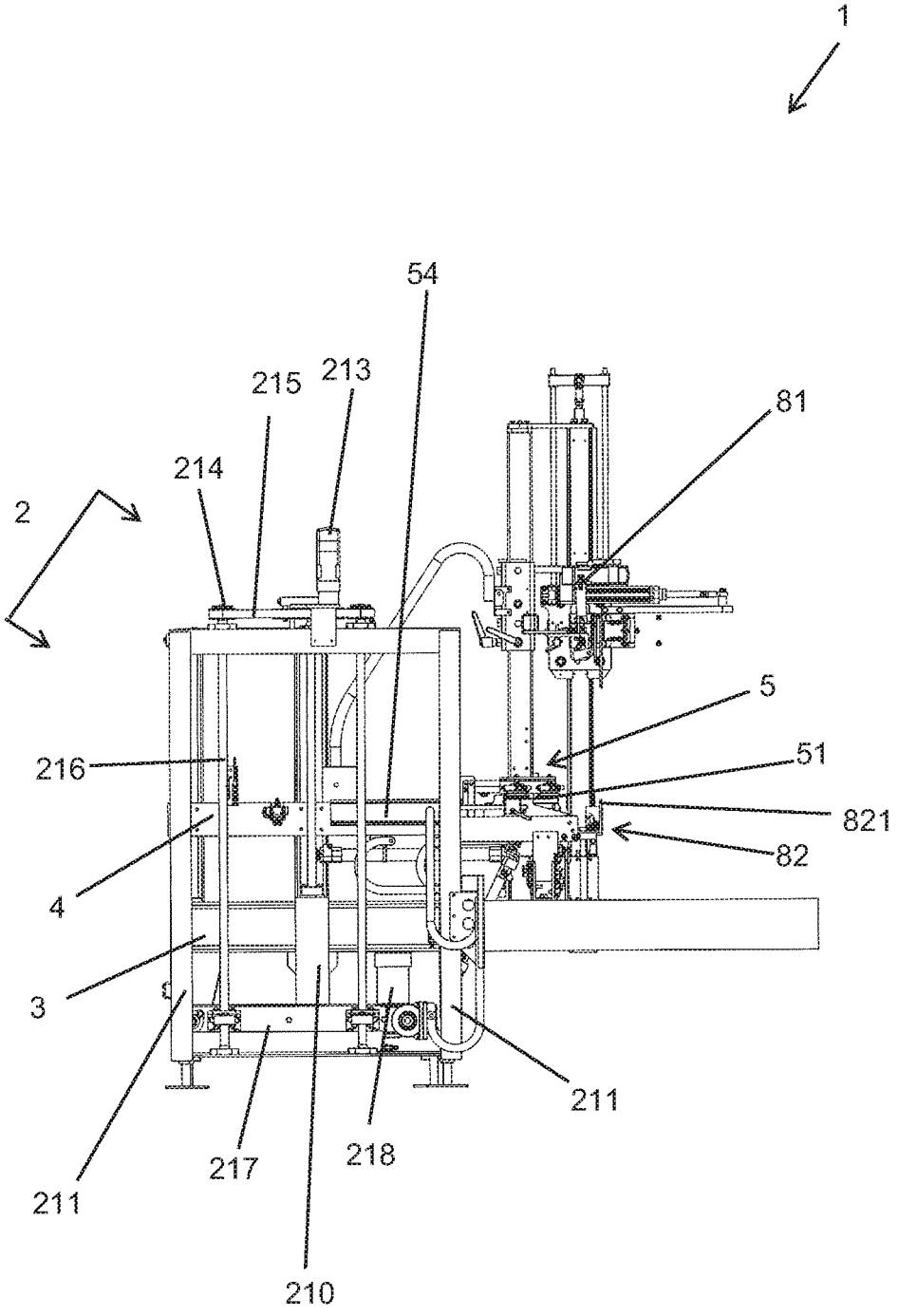
FIG. 2 is a side view of the carton forming machine from folded carton blanks storage rack to folded carton blank opening device.
Figure 3:
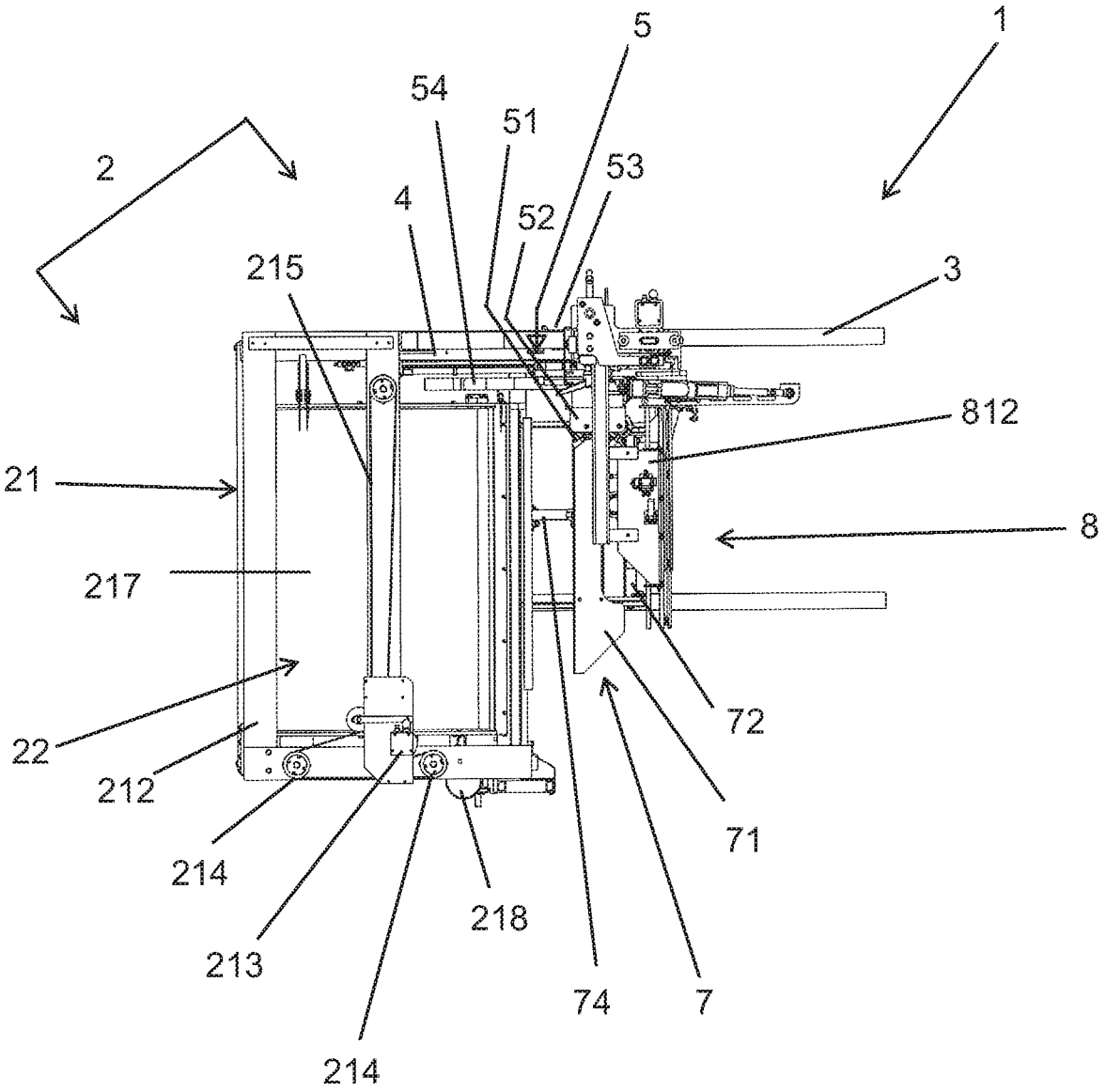
FIG. 3 is a top view of the carton forming machine from folded carton blanks storage rack to Folded carton blank opening device.
Figure 4:
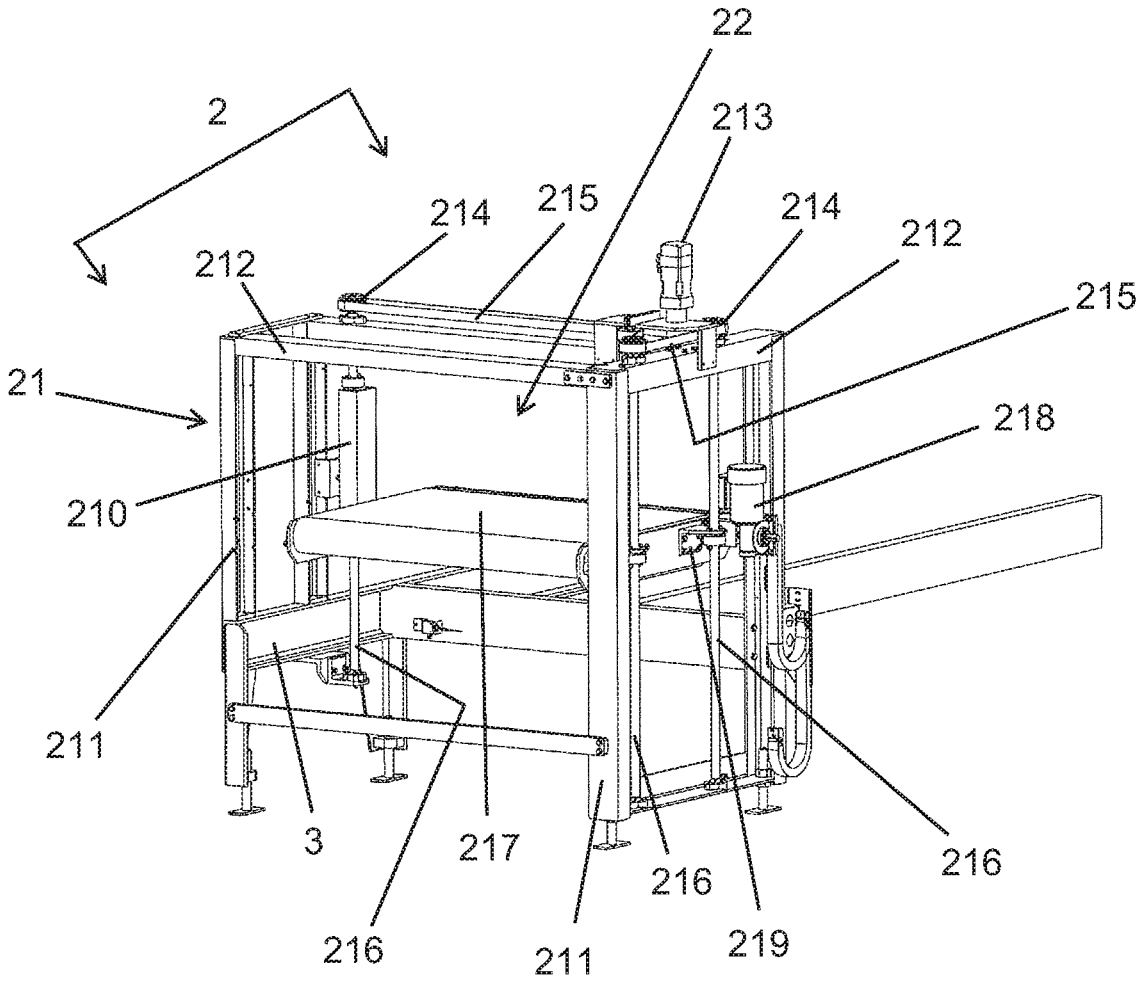
FIG. 4 is a perspective view of the folded carton blanks transport device and folded carton blank vertical transport device.

The carton blanks feeding system 2 includes a folded carton blanks storage rack 21, a folded carton blanks transport device 22 and a blocking plate 23. The folded carton blanks storage rack 21 has four long flat metal bars 211 and they form the legs of the folded carton blanks storage rack 21. On the top of the four long flat metal bars 211, four flat bars 212 are mounted to form the frame of the folded carton blanks storage rack 21. In FIG. 4, the folded carton blanks transport device 22 is composed of a motor 213, five pulleys 214 which are linked with one driven belt 215, a conveyor belt 217 and a motor 218. Three of the said pulleys 214 are mounted on three vertical threaded shafts 216. When the motor 213 drives the driven belt 215 to move, then the pulleys 214 connected with the driven belt 215 are also moved; as the pulleys 214 are connected with the three vertical threaded shafts 216, the action will drive the conveyor belt 217 moving upward for top horizontal folded carton blank 6 pick up or moving downward for re-load of folded carton blanks. The motor 218 can move the conveyor belt 217 inward or outward so as to help load or eject the folded carton blanks.

Figure 5:
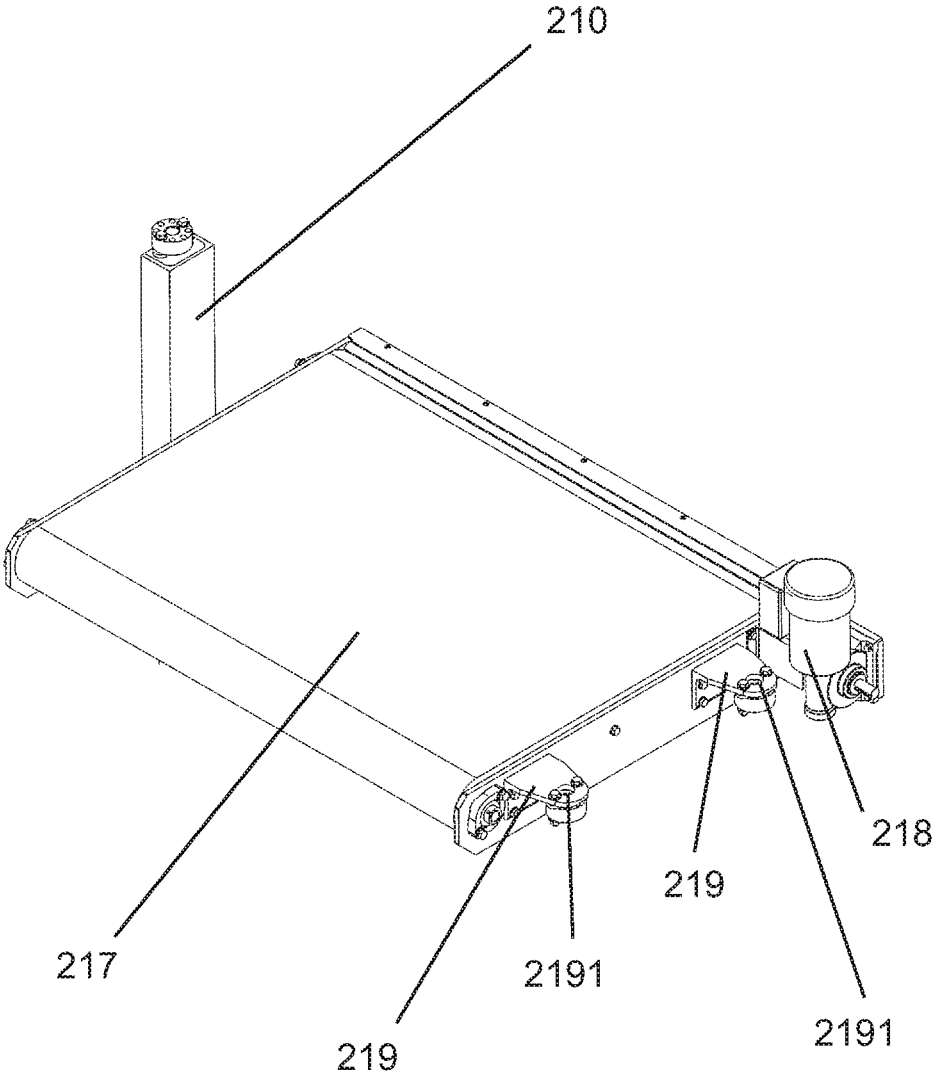
FIG. 5 is a perspective view of the carton blanks transport conveyor device.
Figure 6:
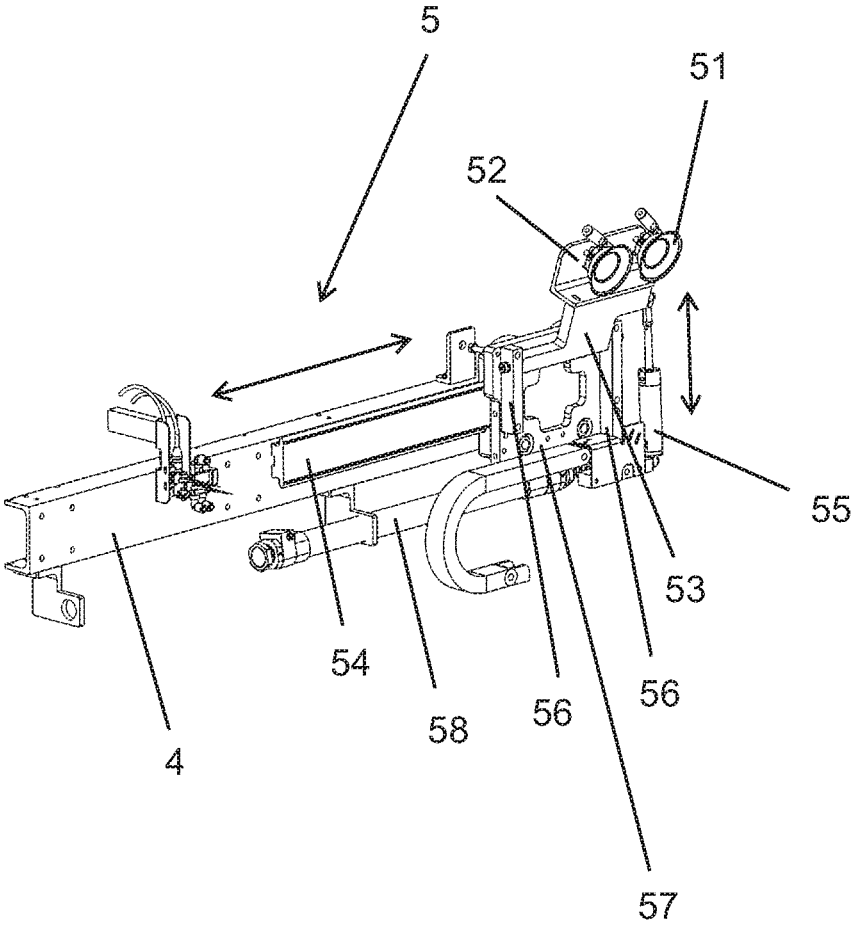
FIG. 6 is a perspective view of the folded carton blank pick up device.

At the one side of the conveyor belt 217, two metal plates 219 are mounted and each metal plate 219 has a hole 2191 on the center which allows the vertical long moving rods 216 to pass through. At the opposite side, a vertical bar 210 is mounted with the conveyor belt 217. The said vertical bar 210 is used for one of the vertical long moving rod 216 to link with. In FIG. 5, the motor 218 is located at the side of the conveyor belt 217, which is used to drive the conveyor belt 217 to move inward or outward.

The folded carton blank pick up device 5 hastwo suction cups 51 which are mounted on a "¬" shape short plate 52, this "¬" shape short plate 52 is mounted on a flat plate 53 and the said flat plate 53 is mounted on two vertical small bars 56. Then the two vertical small bars 56 are mounted a rectangular shape plate 57 and this rectangular shape plate 57 is mounted on a moving bar 54 and a pneumatic cylinder 55 is used to push the suction cups 51 to swing down to pick up the top horizontal folded carton blanks 61. Another pneumatic cylinder 58 is mounted at the bottom of the rectangular shape plate 57, it is used to move forward or backward of suction cups 51 that are mounted on the rectangular shape plate 57. The forward movement lets the suction cups 51 to reach the carton storage rack 21 to pick the top horizontal folded carton blank 61 and go back to the original position to place the horizontal folded carton blank 61 on the folded carton blank stand up device 7.

Figure 7:
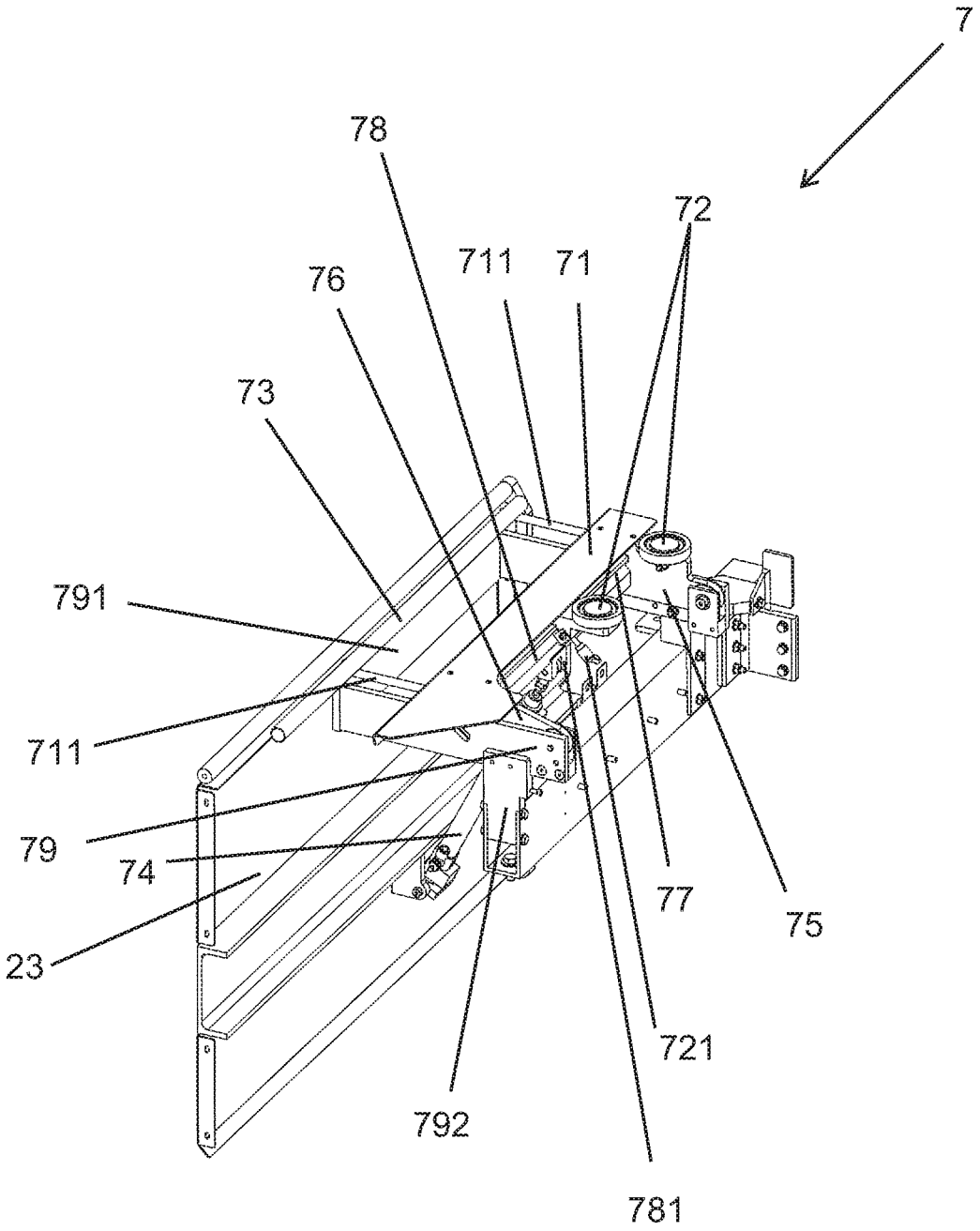
FIG. 7 is a perspective view of the folded carton blank stand up device.
Figure 9:
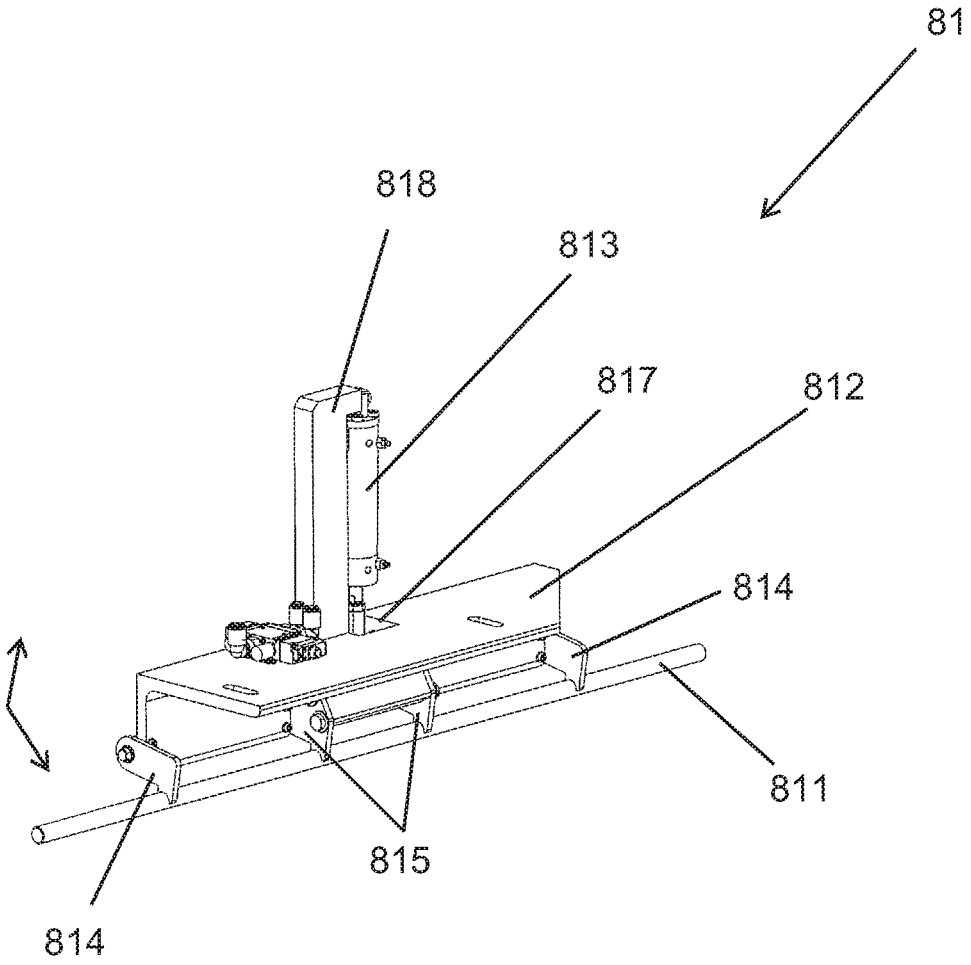
FIG. 9 is a perspective view of the top flap push device.
Figure 11:
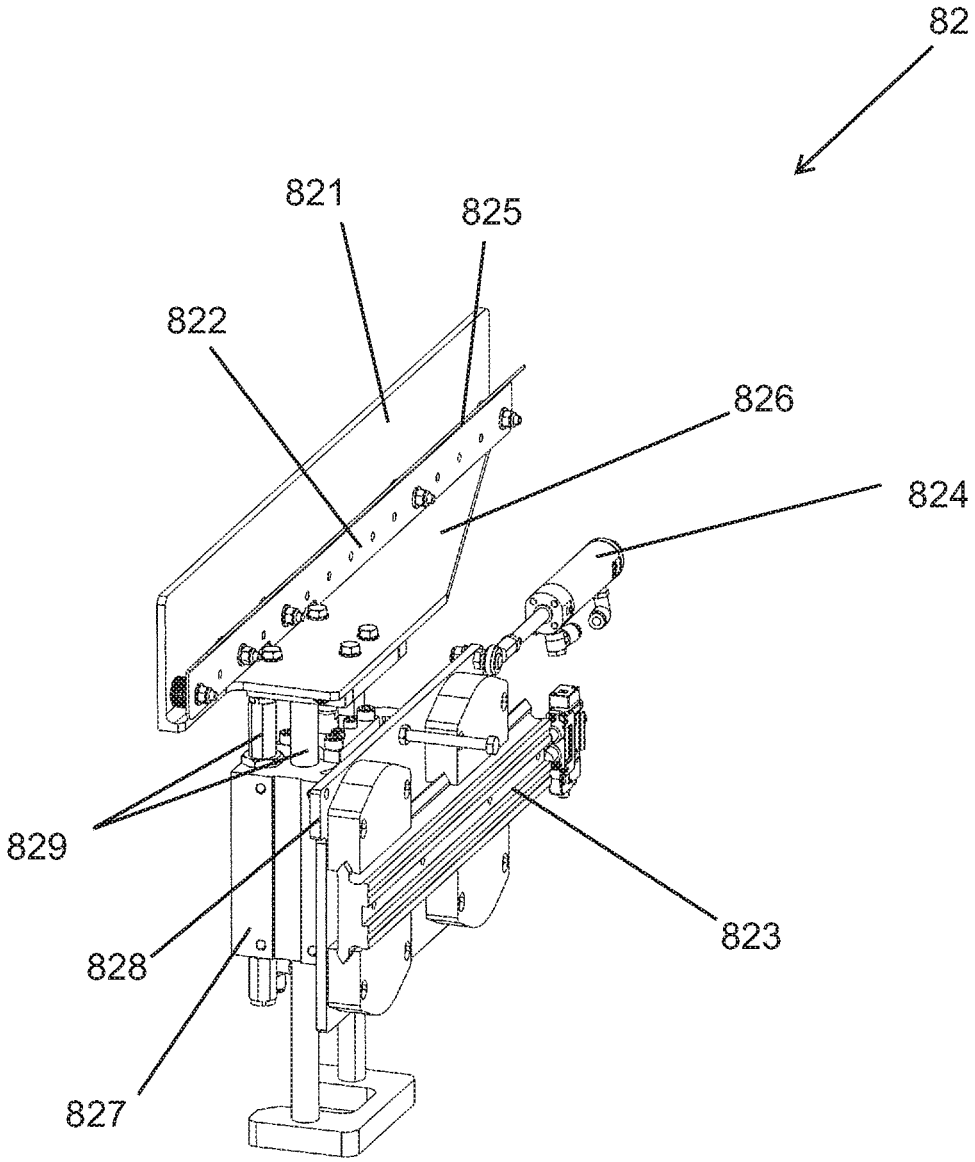
FIG. 11 is a perspective view of the accurate carton apparatus and bottom flap position device.

The folded carton blank stand up device 7 composed of a long flat plate 71, two grippers 72, a long rod 73 and a pneumatic cylinder 74. The said long flat plate 71 is mounted on two metal plates 75, 76 respectively. On the top of the metal plate 75, a gripper 72 is mounted and cannot move. A movable rod 77 is also mounted on the middle of the two metal plates 75, 76. This movable rod 77 allows another gripper 72 to mount on it and the said gripper 72 is movable along the movable rod 77 with a switch 721. The purpose of the movable gripper 72 is to allow the adjustment of the distance between the two grippers 72 so as to hold abnormally large or small size folded carton blanks. Adjustment requires only switching the switch 721 and move the gripper 72 and locking the switch 721 again, which is very easy. Below the movable rod 77, a bar 78 is mounted between the two metal plates 75, 76. At the middle of the bar 78, a "∩" shape small metal 781 is mounted which is used to link with the pneumatic cylinder 74. At the back of the long flat plate 71, two small rods 711 are mounted and connected to the long rod 73. The two metal plates 75, 76 are connected to two long rectangular bars 79. The two long rectangular bars 79 allow the two metal plates 75, 76 to be movable. At the back of the two long rectangular bars 79, another long bar 791 is mounted to the bars and on the blocking plate 23. In FIG. 7, the two long rectangular bars 79 are mounted on two small metal bars 792.

FIGS. 8*a*-8*d* is different views of the folded carton blank stand up device 7. FIG. 8*a*, FIG. 8*c* and FIG. 8*d* show the top, side and front views of the folded carton blank stand up device 7. FIG. 8*b* shows the structure view of the folded carton blank stand up device 7.

At the back of the long flat plate 71, two small rods 711 are mounted. The two small rods 711 are connected with the long rod 73. One of the gripper 72 is mounted on the metal plate 75 and cannot move. The two metal plates 75, 76 are connected with two long rectangular bar 79. The whole folded carton blank stand up device 7 is mounted on the blocking plate 23.

The top flap push device 81 of the accurate carton apparatus 8 includes a long rod 811, a "¬" shape plate 812 and a pneumatic cylinder 813. The long rod 811 has a pair of flat plates 814 which are used to mount on the "¬" shape plate 812. At the center of the long rod 811, two plates 815 are mounted. The two plates 815 connected with a "⊥" shape metal 816. At the center of the "¬" shape plate 812, a hole 817 is used to let the vertical "⌈r" shape bar 818 to pass through. The vertical "⌈" shape bar 818 is mounted to the pneumatic cylinder 813 and the pneumatic cylinder 813 is connected to the "⊥" shape metal 816 to allow the pneumatic cylinder 813 to push the long rod 811 forward and backward in order to press the folded carton blank 61 firmly under the folded carton blank opening device (known technology).

The bottom flap positioning device 82 of the accurate carton apparatus 8 has a "∟" shape bar 821, a small long bar 822, a moving rail 823, and a pneumatic cylinder 824. The "∟" shape bar 821 and the small long bar 822 are mounted together and form a groove 825. The groove 825 allows the bottom flap of the folded carton blank 61 to fall in it. The "∟" shape bar 821 and the small long bar 822 are mounted on a trapezoid shape flat bar 826. The trapezoid shape flat bar 826 is connected with four rods 829. These four rods 829 are mounted on a thick metal bar 827. The thick metal bar 827 is mounted on a flat plate 828. On the other side of the flat plate 828, a moving rail 823 is mounted. At the front end of the flat plate 828, the pneumatic cylinder 824 is mounted. The pneumatic cylinder 824 will push the flat plate 828, which is linked with the "∟" shape bar 821 and the small long bar 822, causing movement forward or backward in order to position the bottom flap of the folded carton blank 61 by hitting the side of the folded carton blank 61 to the position bar 9 located at the side under the folded carton blank opening device for flaps opening.

Figure 12:
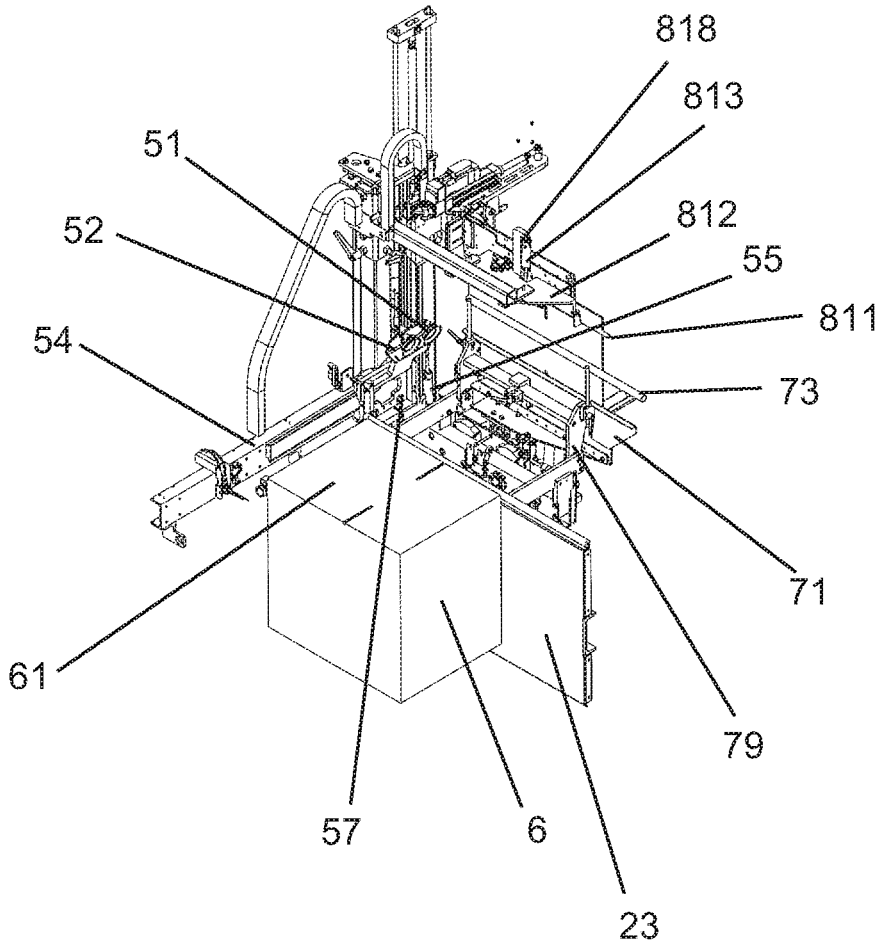
FIGS. 12-18B depict an illustration of how the carton blanks feeding system transports carton blanks to the carton blanks erecting device.
Figure 13:
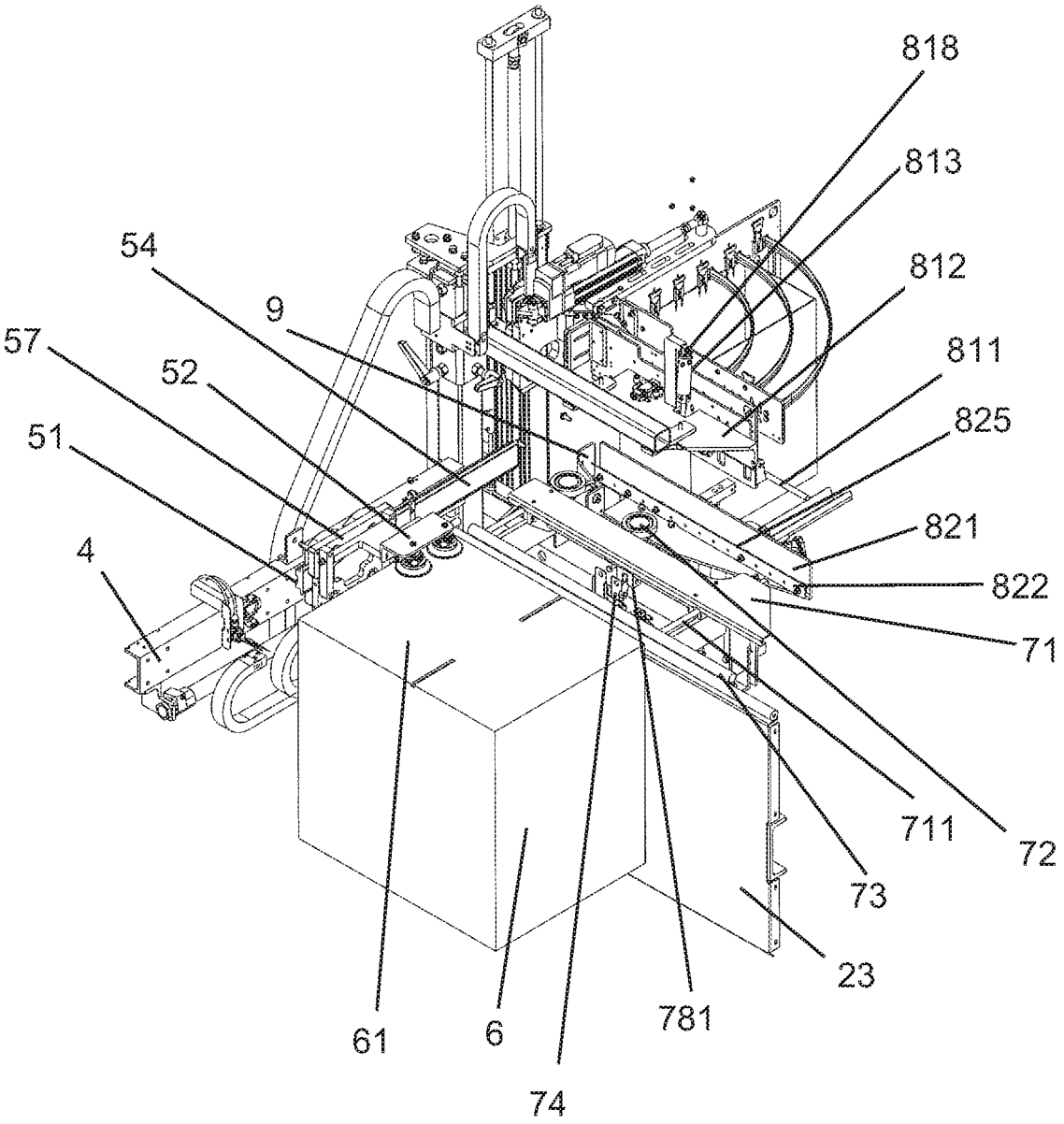
Figure 14A:
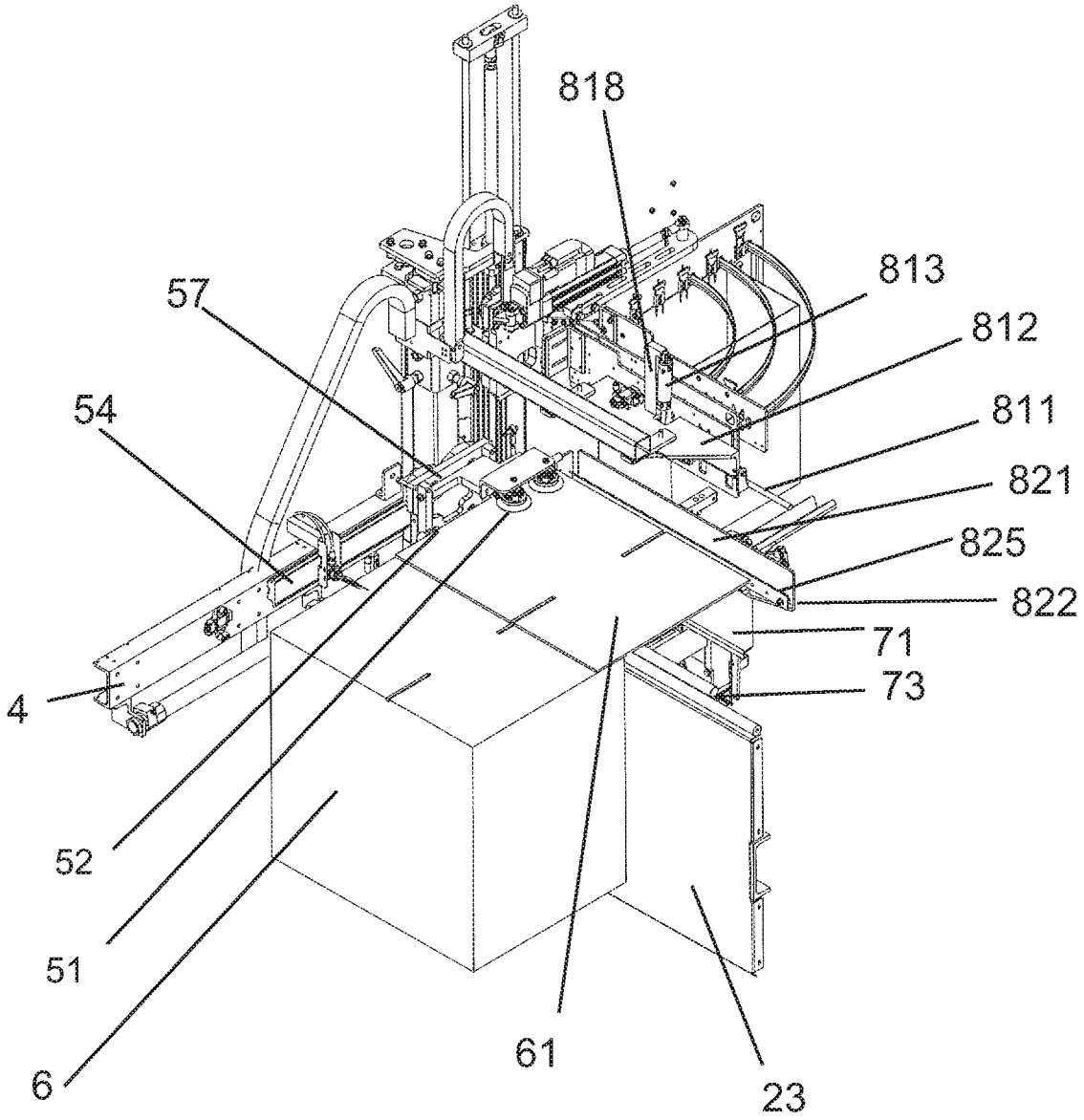
Figure 14B:
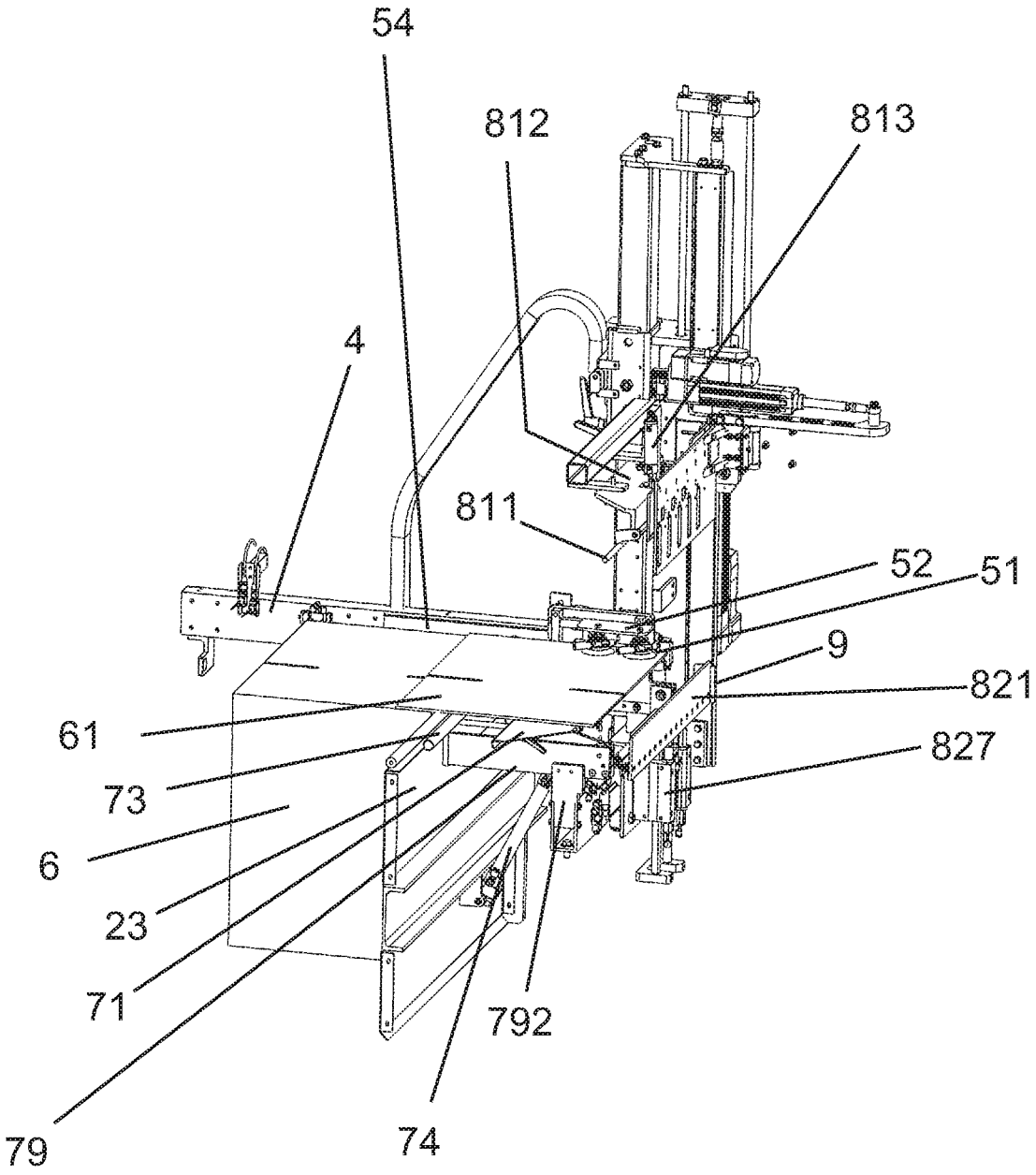
Figure 15A:
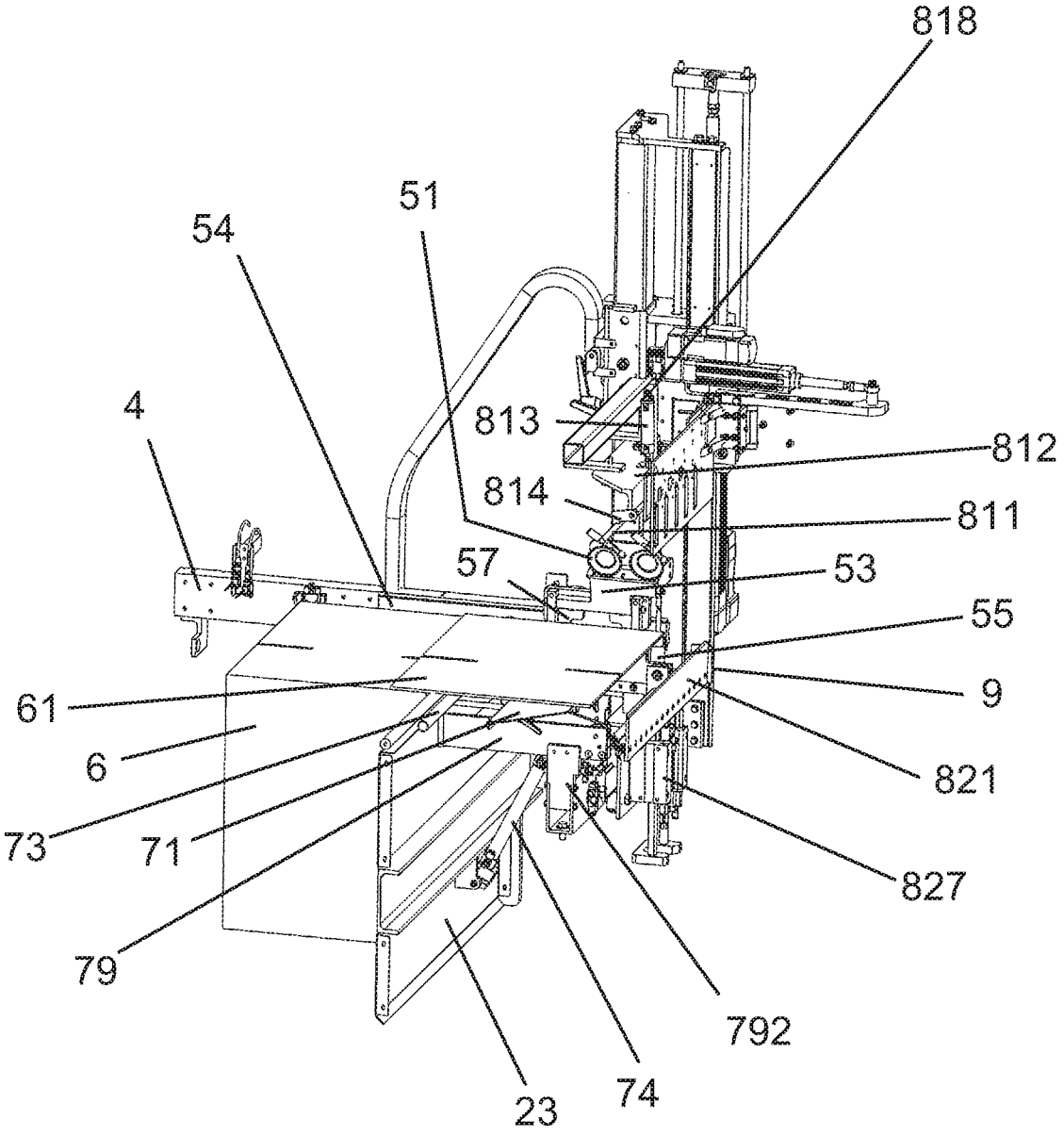
Figure 15B:
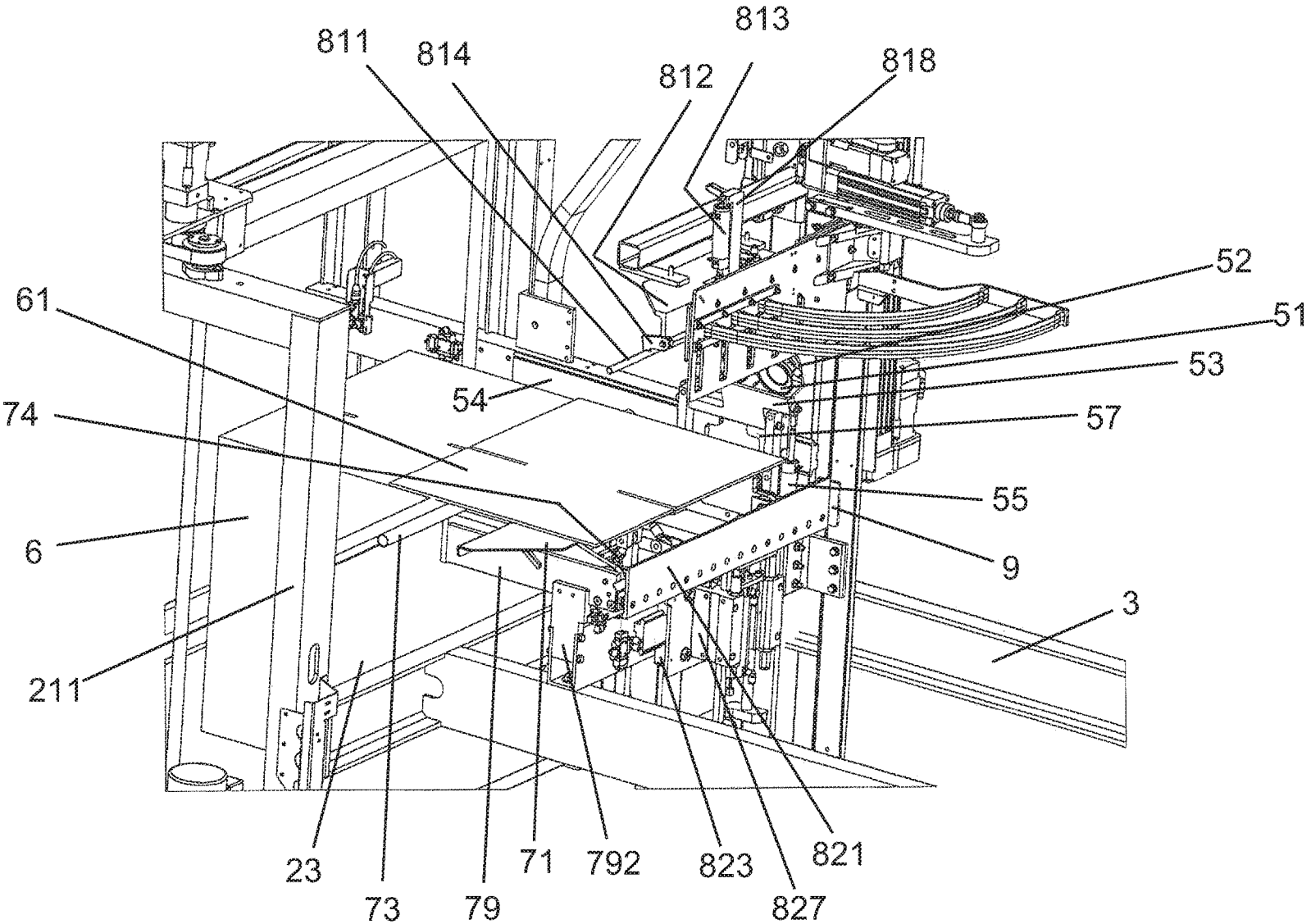
Figure 16:
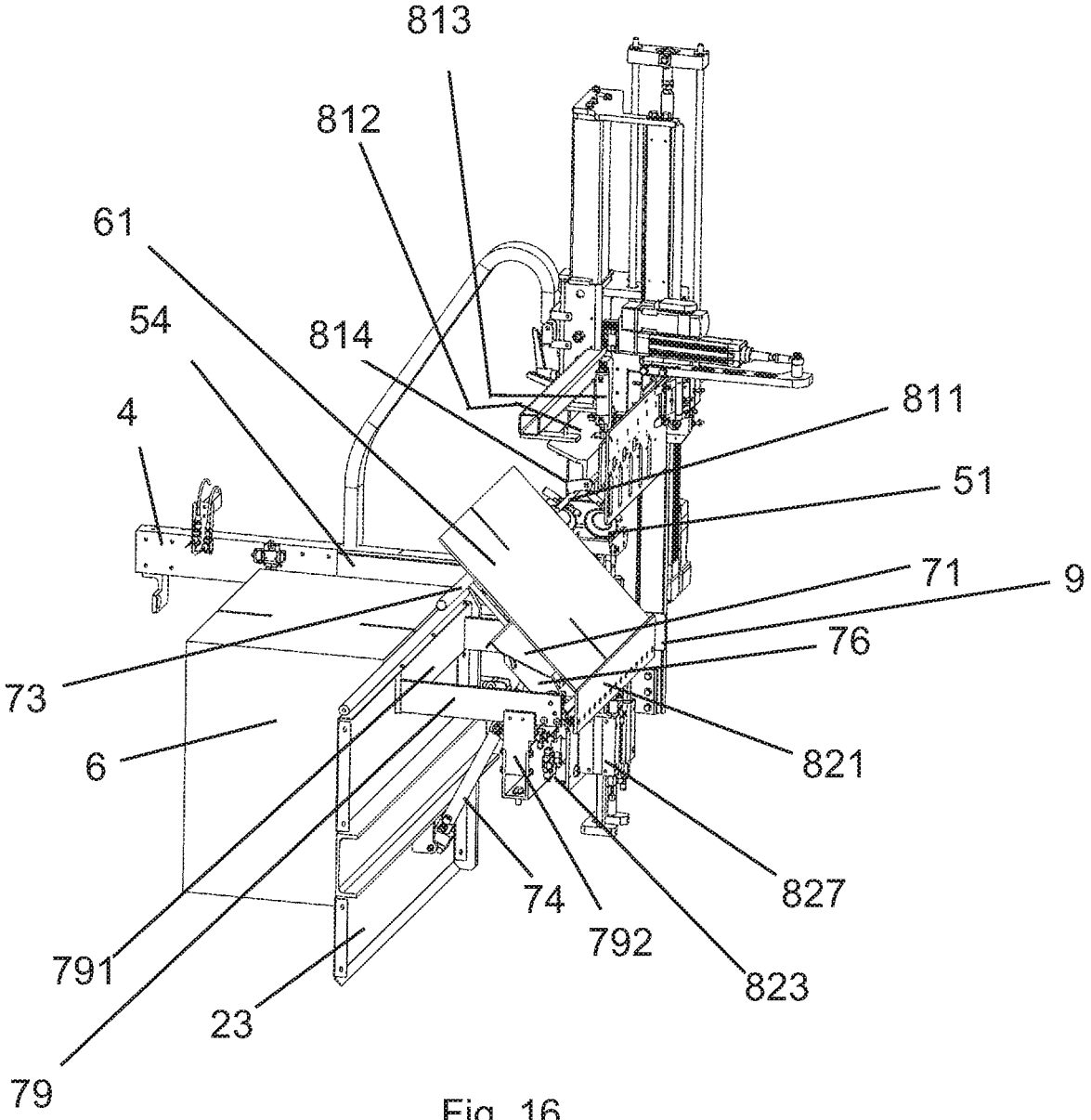
Figure 17A:
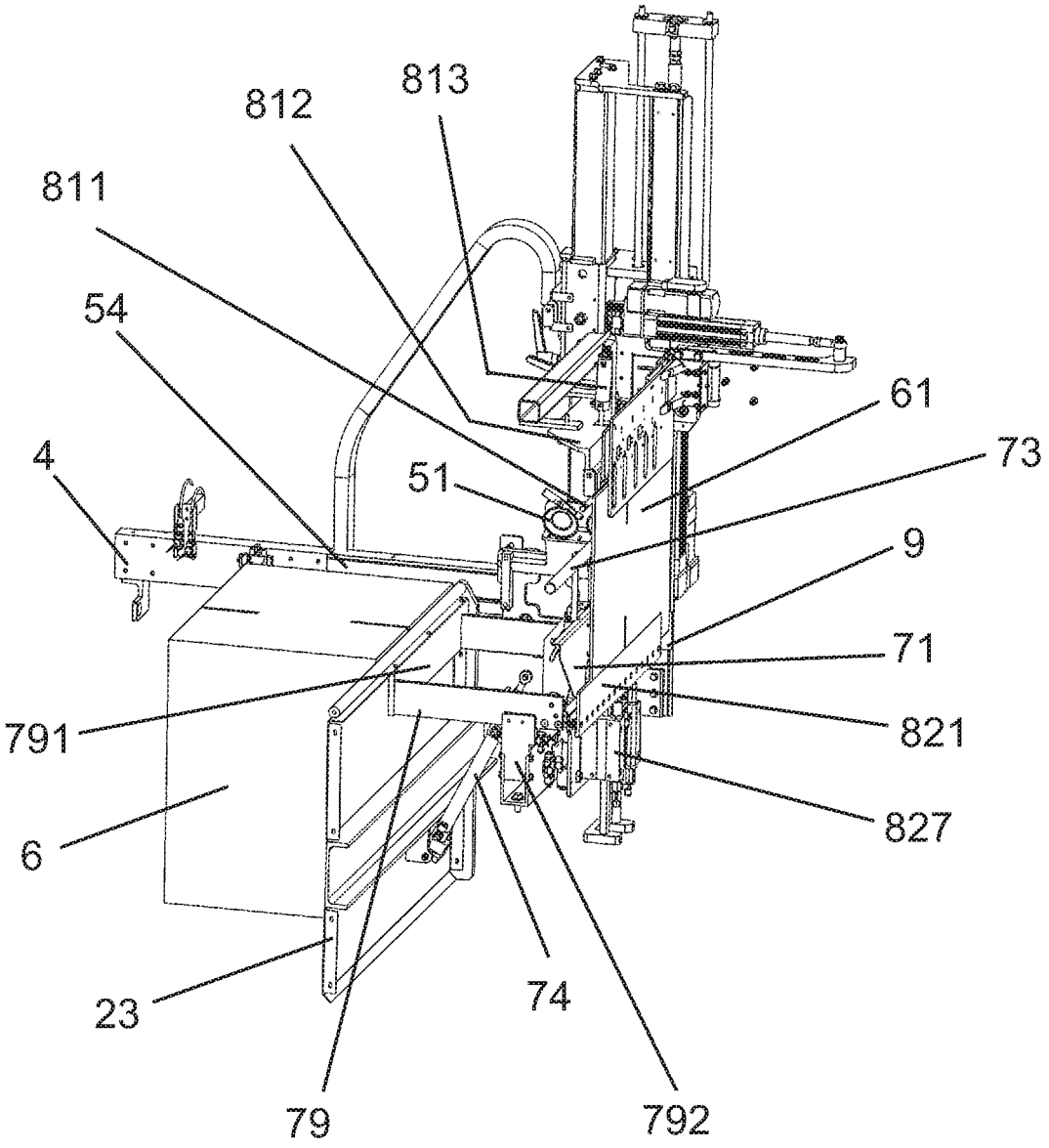
Figure 17B:
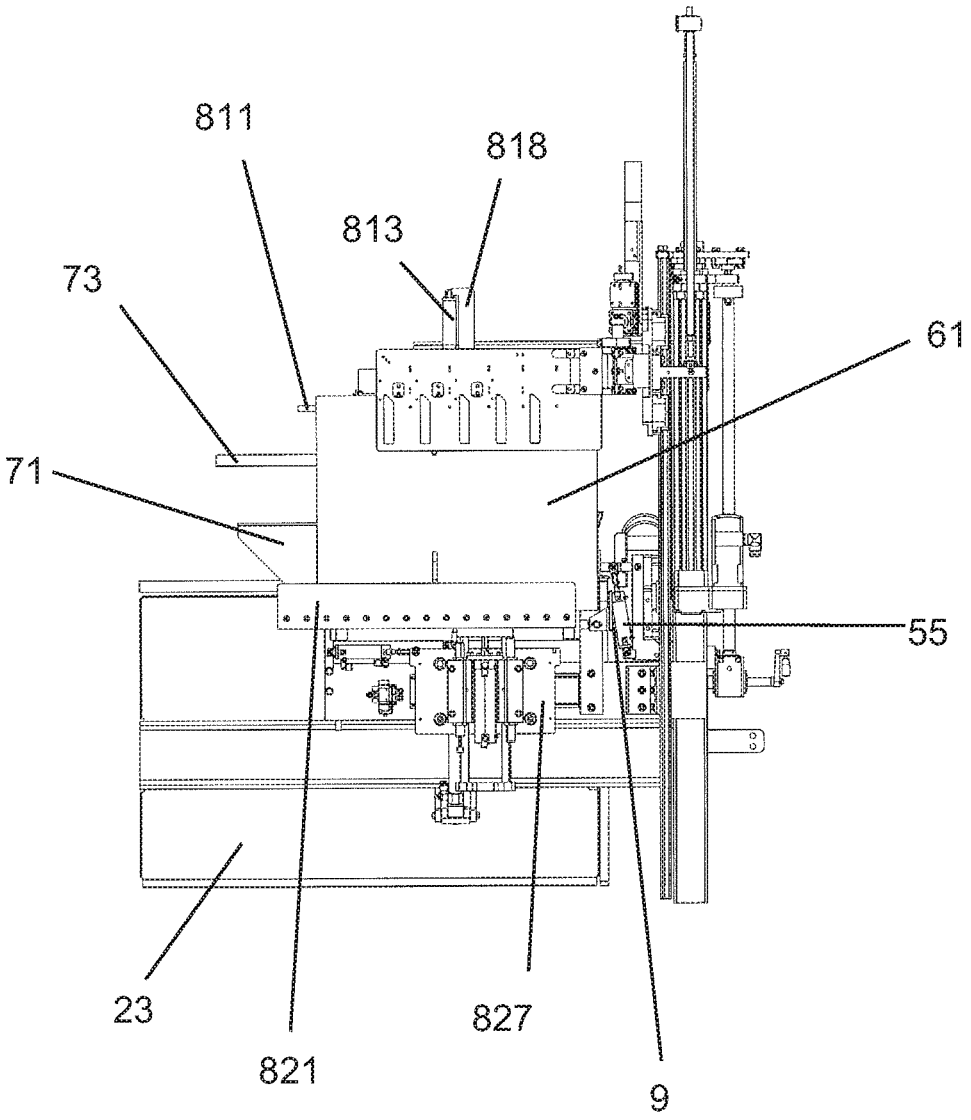
Figure 17C:
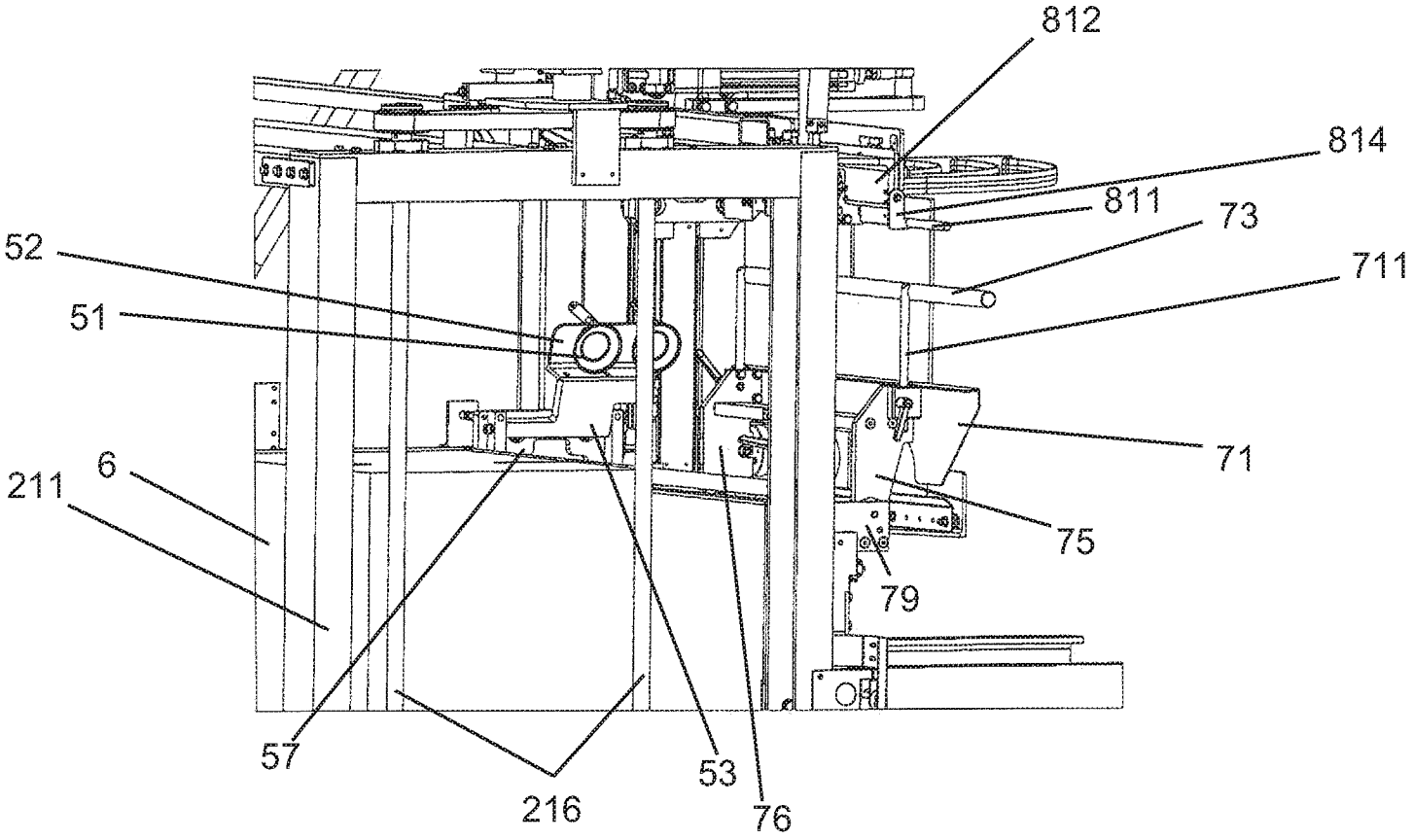
Figure 18A:
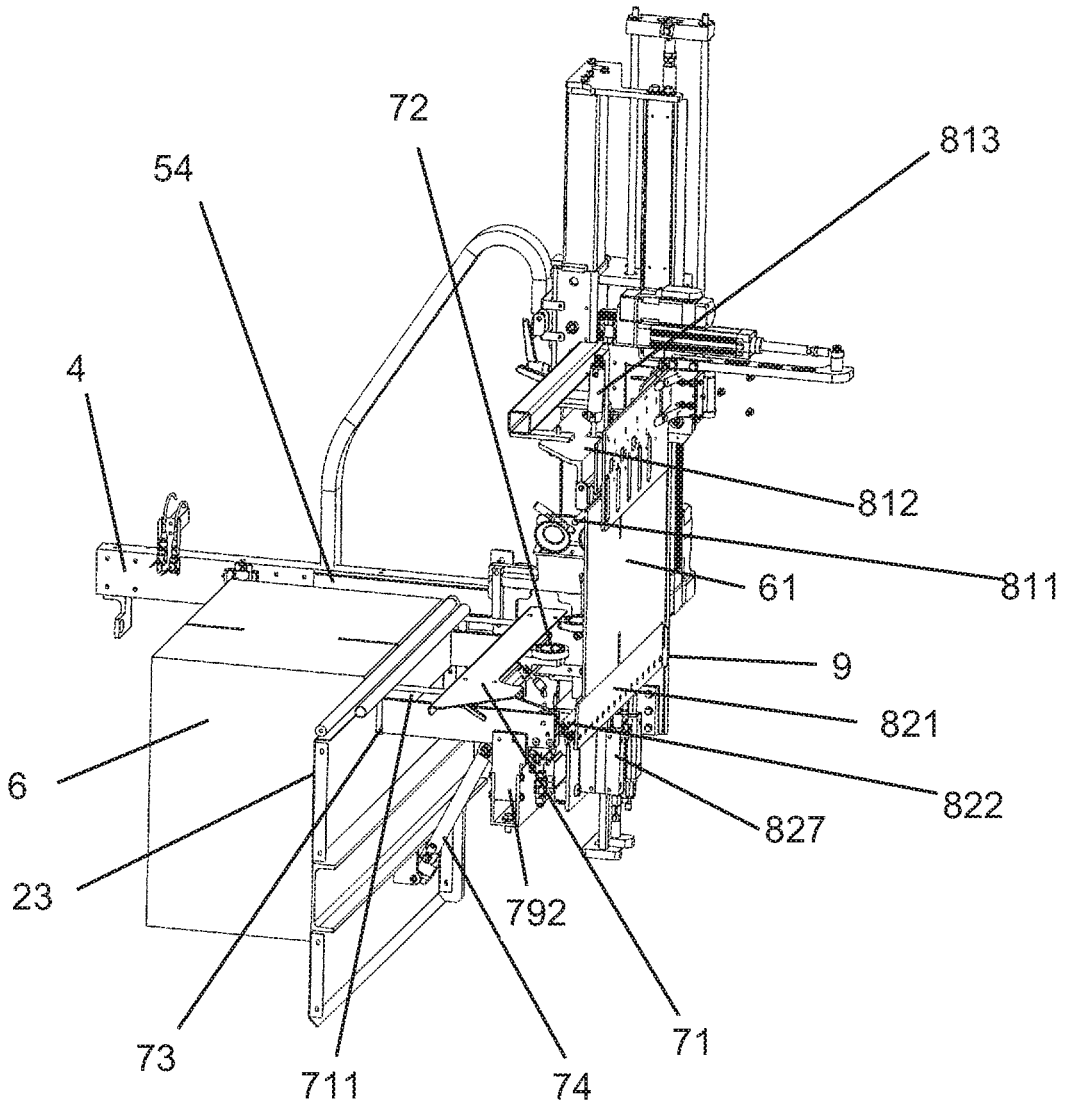
Figure 18B:
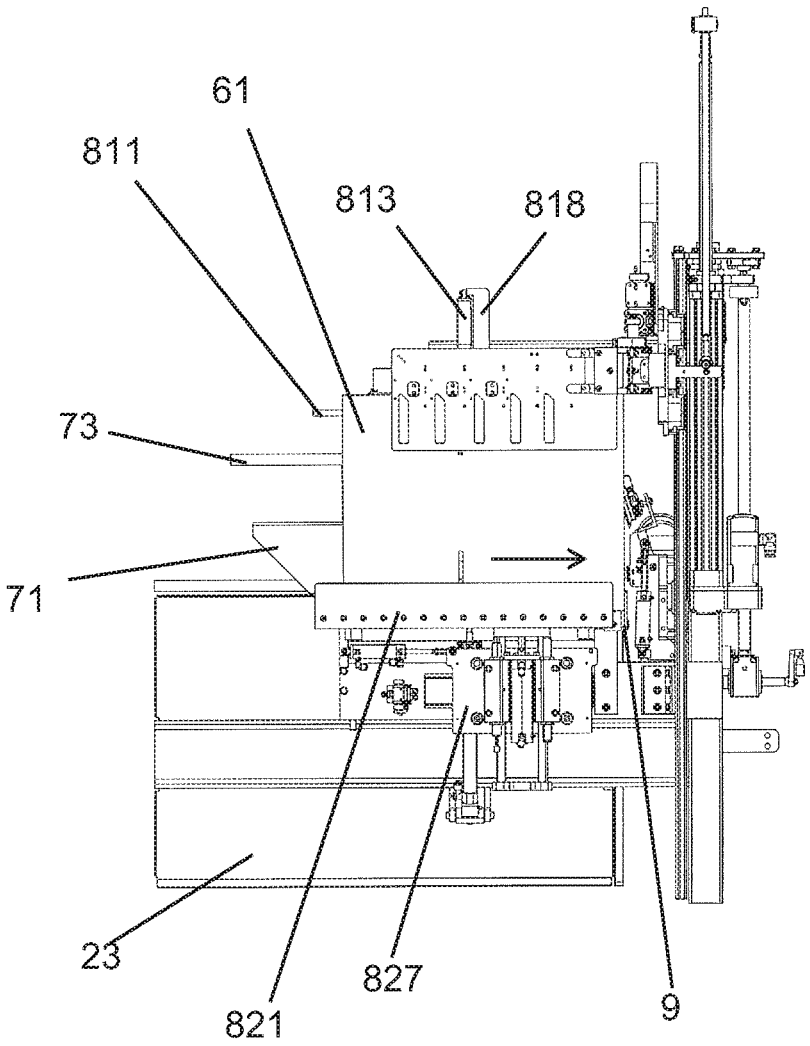

FIG. 12-18*b* show the operational views depicting how the carton forming machine 1 moves and stretches open a horizontal folded carton blanks 61. In FIG. 12, a pile/stack of horizontal folded carton blanks 6 is placed in the folded carton blanks storage rack (not shown). The suction cups 51 of the folded carton blank pick up device 5 are in an up position, which is in preparation to pick up a horizontal folded carton blank 61. Per FIG. 12, the rectangular shape plate 57, is controlled by the pneumatic cylinder 58 to move forward to the pile of horizontal folded carton blanks 6 and the suction cups 51 are controlled by the pneumatic cylinder 55 swing down to pick up the top horizontal folded carton blank 61. At the same time, the folded carton blank stand up device 7 and the accurate carton apparatus 8 are in a ready state. FIGS. 14*a* and 14*b* are the different views showing how the folded carton blank 61 is transported to the folded carton blank stand up device 7. In detail, after the suction cups 51 pick up the folded carton blank 61, the pneumatic cylinder 58 will move backward and transport the folded carton blank 61 to the folded carton blank stand up device 7. In FIGS. 15*a* and 15*b*, after the suction cups 51 place the folded carton blank 61 on the folded carton blank stand up device 7, the suction cups 51 will release the folded carton blank 61 and the pneumatic cylinder 55 will drive the flat plate 53 back to an up position. Referring to FIG. 16, the folded carton blank 61 is pushed up gradually by the folded carton blank stand up device 7, and the bottom flap of the folded carton blank 61 is inserted inside the groove 825 under folded carton blank opening device. FIGS. 17*a*-17*c* show the folded carton blank 61 standing vertically under the folded carton blank opening device and the bottom flap of the folded carton blank 61 within the groove 825 formed between the said "∟" shape bar 821 and the small long bar 822. In order to prevent the folded carton blank 61 from falling back down, the long rod 73 and the long flat plate 71 of the folded carton blank stand up device 7 remain in the vertical position so as to press the folded carton blank 61 to stand vertically. At the same time, in order to aid in preventing the folded carton blank 61 falling back, the long rod 811 of the top flap push device 81, controlled by pneumatic cylinder 813 will press the folded carton blank 61 against the folded carton blank opening device. As shown in FIGS. 18*a* and 18*b*, the folded carton blank 61 stands vertically with the bottom flap entered into the groove 825 formed by the said "∟" shape bar 821 and the small long bar 822. The pneumatic cylinder 824 of the accurate carton apparatus 82 will then move backward, causing the "∟" shape bar 821 and the small long bar 822 to also move backward and causing the side of the folded carton blank 61 to move into contact with the positioning bar 9 and finally position the folded carton blank 61 accurately under the folded carton blank opening device.

It is to be clearly understood that the above description is intended by way of illustration and example only, is not intended to be taken by way of limitation, and that other changes and modifications are possible.

What is claimed is:

1. A carton forming machine, comprising:

a carton blank storage rack holding a carton blank stack formed by a plurality of substantially horizontal folded carton blanks;

a carton blank transport device arranged to pick a folded carton blank from the carton blank stack and transport the folded carton blank in a conveyance direction along a conveyance path toward a carton opening mechanism;

a carton blank push up device that receives the folded carton blank from the carton blank transport device and reorients the folded carton blank from the substantially horizontal orientation to an upright orientation below the carton opening mechanism to provide an upright folded carton blank; and a carton blank positioning apparatus that receives and supports the upright folded carton blank and shifts the upright folded carton blank in a set direction transverse to the conveyance direction in order to establish an accurate lateral position of the upright folded carton blank below the carton opening mechanism before the carton opening mechanism engages the upright carton blank for opening of the upright carton blank;

wherein the carton blank positioning apparatus includes an elongated bar with an upward facing receiving slot in which bottom edges of flaps on the upright folded carton blank are positioned, wherein the elongated bar, including the upward facing receiving slot, is movable in the set direction in order to shift the upright folded carton blank in the set direction to establish the accurate lateral position;

wherein the carton blank push up device receives the folded carton blank from the carton blank transport device at a location in which the folded carton blank is spaced, along the conveyance direction, from the upward facing receiving slot of the carton blank positioning apparatus.

2. The carton forming machine of claim 1 wherein the carton blank transport device is arranged above the carton blank storage rack and picks the folded carton blank from a top of the carton blank stack, the carton blank transport device including at least one suction cup to engage the folded carton blank.

3. The carton forming machine of claim 1 wherein the carton blank positioning apparatus includes a stop surface in line with one end of the elongated bar, the elongated bar moves in the set direction such that one side of the upright folded carton blank contacts the stop surface to define the accurate lateral position of the upright folded carton blank.

4. The carton forming machine of claim 3 wherein after the one side of the upright folded carton blank contacts the stop surface continued movement of the elongated bar in the set direction causes the elongated bar to slide relative to the upright folded carton blank sitting in the upward facing receiving slot.

5. The carton forming machine of claim 3 wherein a position of the stop surface along the set direction is adjustable to permit adjustment to accommodate different carton blank sizes.

6. The carton forming machine of claim 1 wherein the elongated bar is in a first position when the upright folded carton blank is initially loaded into the upward facing receiving slot, and one side of the upright folded carton blank protrudes beyond one end of the elongated bar.

7. A carton forming machine, comprising:

a carton blank push up device that receives a substantially horizontal folded carton blank and reorients the substantially horizontal folded carton blank to an upright orientation to provide an upright folded carton blank below and in a first direction alignment with a carton opening mechanism; and a carton blank positioning apparatus that shifts the upright folded carton blank in a second direction, transverse to the first direction, below the carton opening mechanism to define a second direction position of the upright folded carton blank below the carton opening mechanism before the carton opening mechanism engages the upright folded carton blank for opening of the upright folded carton blank;

wherein the carton blank positioning apparatus includes an elongated member with an upward facing slot supporting bottom edges of flaps on the upright folded carton blank and the elongated member, including the upward facing slot, is movable in the second direction in order to define the second direction position;

wherein the carton blank positioning apparatus includes a stop surface toward one end of the elongated member, wherein the elongated member, including the upward facing slot, is movable in the second direction such that one side of the upright folded carton blank contacts the stop surface to define the second direction position of the upright folded carton blank.

8. The carton forming machine of claim 7 wherein the carton blank positioning device includes a top flap pusher movable between an upright position and a lowered push position, in the upright position the top flap pusher is above a travel path of the substantially horizontal folded carton blank as the substantially horizontal folded carton blank moves from the substantially horizontal orientation to the upright orientation, in the lowered push position the top flap pusher engages a trailing side of top flaps of the substantially horizontal folded carton blank.

9. The carton forming machine of claim 8 wherein the top flap pusher is mounted for pivotal movement between the upright position and the lowered push position.

10. The carton forming machine of claim 8 wherein the top flap pusher pushes a leading side of some of the top flaps against a panel member of the carton forming machine.

11. The carton forming machine of claim 7 wherein the carton blank push up device includes a first gripper and a second gripper, the first gripper has a fixed position and the second gripper is movable in the second direction to enable adjustment of a spacing between the first gripper and the second gripper to accommodate different carton blank sizes.

12. The carton forming machine of claim 11 wherein an actuator is operatively connected for movement of the second gripper, and the actuator is controllable by a switch that is configured to be manually activated when the carton forming machine is not operating to form cartons.

* * * * *